US007650914B2

(12) United States Patent
Bogursky et al.

(10) Patent No.: US 7,650,914 B2
(45) Date of Patent: Jan. 26, 2010

(54) APPARATUS AND METHODS FOR FILAMENT CRIMPING AND MANUFACTURING

(75) Inventors: Robert Bogursky, Encinitas, CA (US); Leonid Foshansky, San Diego, CA (US); Craig Kennedy, San Marcos, CA (US); Darryl Wood, Santee, CA (US); Mark Saunders, Boyertown, PA (US)

(73) Assignee: Autosplice, Inc., San Diego, CA (US)

( * ) Notice: Subject to any disclaimer, the term of this patent is extended or adjusted under 35 U.S.C. 154(b) by 82 days.

(21) Appl. No.: 11/473,567

(22) Filed: Jun. 22, 2006

(65) Prior Publication Data

US 2007/0294873 A1 Dec. 27, 2007

(51) Int. Cl.
*B21F 1/00* (2006.01)

(52) U.S. Cl. ..... 140/105

(58) Field of Classification Search ..... 140/105, 140/106; 72/306, 307, 381–384
See application file for complete search history.

(56) References Cited

U.S. PATENT DOCUMENTS

| | | | | |
|---|---|---|---|---|
| 2,854,648 | A | 9/1958 | Berg | |
| 2,965,699 | A | 12/1960 | Bollmeier | |
| 3,438,407 | A * | 4/1969 | Over | 140/111 |
| 3,879,981 | A * | 4/1975 | Richards | 72/409.01 |
| 4,043,174 | A * | 8/1977 | Paolino | 72/412 |
| 4,551,974 | A | 11/1985 | Yaeger et al. | |
| 4,806,815 | A | 2/1989 | Honma | |
| 5,312,152 | A | 5/1994 | Woebkenberg, Jr. et al. | |
| 5,440,193 | A | 8/1995 | Barrett | |
| 5,486,653 | A | 1/1996 | Dohi | |
| 5,563,466 | A | 10/1996 | Rennex et al. | |
| 5,685,148 | A | 11/1997 | Robert | |
| 5,763,979 | A | 6/1998 | Mukherjee et al. | |
| 5,870,007 | A | 2/1999 | Carr et al. | |
| 6,004,171 | A | 12/1999 | Ito et al. | |
| 6,056,605 | A | 5/2000 | Nguyen et al. | |
| 6,232,555 | B1 | 5/2001 | Besler et al. | |
| 6,236,300 | B1 | 5/2001 | Minners | |
| 6,326,707 | B1 | 12/2001 | Gummin et al. | |
| 6,379,393 | B1 | 4/2002 | Mayroidis et al. | |
| 6,425,829 | B1 | 7/2002 | Julien | |

(Continued)

FOREIGN PATENT DOCUMENTS

| | | |
|---|---|---|
| EP | 0785709 | 7/1997 |

(Continued)

*Primary Examiner*—Dana Ross
*Assistant Examiner*—Teresa M Bonk
(74) *Attorney, Agent, or Firm*—Gazdzinski & Associates, PC

(57) ABSTRACT

Apparatus and methods for filament crimping. In one embodiment, the apparatus comprises a body and a filament crimp element. The filament crimp element comprises a first set of cavities disposed at a spacing which creates a first set of features and a second set of cavities disposed at a spacing which creates a second set of features. The first and second set cavities are substantially opposite one another. The first set of features are adapted to be placed at least partially within the second set of cavities and the second set of features are adapted to be placed at least partially within the first set of cavities. Methods and apparatus for the manufacture of the device are also disclosed. In addition, methods for automated placement and manufacture of assemblies using the crimp elements are also disclosed.

30 Claims, 25 Drawing Sheets

U.S. PATENT DOCUMENTS

| | | | |
|---|---|---|---|
| 6,574,958 | B1 | 6/2003 | MacGregor |
| 6,749,457 | B2 | 6/2004 | Sakaguchi et al. |
| 6,799,990 | B2 | 10/2004 | Wendling et al. |
| 6,832,477 | B2 | 12/2004 | Gummin et al. |
| 6,893,274 | B2 | 5/2005 | Chen et al. |
| 2002/0185932 | A1 | 12/2002 | Gummin et al. |
| 2004/0256920 | A1 | 12/2004 | Gummin et al. |
| 2005/0229670 | A1 | 10/2005 | Perreault |
| 2005/0273020 | A1 | 12/2005 | Whittaker et al. |
| 2005/0273059 | A1 | 12/2005 | Mernoe et al. |
| 2005/0282444 | A1 | 12/2005 | Irish et al. |

FOREIGN PATENT DOCUMENTS

| | | |
|---|---|---|
| EP | 1610418 | 12/2005 |
| GB | 104380 | 10/1966 |

* cited by examiner

APPARATUS AND METHODS FOR FILAMENT CRIMPING AND MANUFACTURING

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD OF THE INVENTION

The present invention relates generally to the field of crimping, and in one salient aspect to fine filament crimping of, e.g., shaped memory alloy (SMA) wire.

DESCRIPTION OF RELATED TECHNOLOGY

The crimping of filaments such as metallic wires is well understood. Numerous techniques and configurations for wire and filament crimps are known. For example, U.S. Pat. No. 5,486,653 to Dohi issued Jan. 23, 1996 entitled "Crimp-style terminal" discloses a crimp-style terminal crimped to connect itself with an end of an electric wire includes an electric connecting part which is electrically connected to the other connecting part; and a crimping part formed integrally with the electric connecting part. The crimping part includes a bottom part and a pair of bends protruding from both sides of the bottom part. Each of the bends is formed to be thinner than the bottom part. In crimping, the pair of bends are deformed in such a manner that each end of the bends is directed to a substantially intermediate position in the width direction of the bottom part, whereby the end of the electric wire is crimped to the terminal securely.

U.S. Pat. No. 6,004,171 to Ito, et al. issued Dec. 21, 1999 and entitled "Crimp-type terminal" discloses a crimp-type terminal for electrically connecting an internal conductor to a mating terminal, includes: an electrical connection portion for fitting connection to the mating terminal; a conductor clamping portion having a base plate, and upstanding walls which extend respectively from opposite side edges of the base plate, and are pressed to clamp the internal conductor; and interconnecting walls respectively connecting the upstanding walls to the electrical connection portion, wherein each of the interconnecting walls have a bend portion for absorbing a stress, produced in a direction of a width of the crimp-type terminal when the interconnecting walls are pressed, by deformation.

U.S. Pat. No. 6,056,605 to Nguyen, et al. issued May 2, 2000 entitled "Contact element with crimp section" discloses apparatus which attempts to reduce the risk of breakage and yet ensure good electric and thermal conductivity, pull-off strength and long service life of the connection, when connecting a contact element to a conductor by crimping, by providing a crimp with the inner surface of the crimp section, in contact with the conductor, having deformations that are grooves and ribs running crosswise and obliquely to the longitudinal axis of the conductor.

U.S. Pat. No. 6,232,555 to Besler, et al. issued May 15, 2001 entitled "Crimp connection" discloses a crimp connection between a flexible flat contact part and a crimping ferrule enclosing this contact part, wherein the crimp connection is characterized in that the crimping ferrule has a base and two side plates adjoining the base on opposite sides. The base has at least one groove towards the interior of the ferrule and transversely to the longitudinal ferrule axis, and ribs arranged at the free ends of the side plates. The ribs at the free end are disposed in such a way that, after crimping has taken place and with the side plates rolled in towards the interior of the ferrule, the said ribs press the flexible contact part into the corresponding groove and engage with the said part essentially positively into the corresponding groove.

U.S. Pat. No. 6,749,457 to Sakaguchi, et al. issued Jun. 15, 2004 entitled "Crimp terminal" discloses a crimp terminal for crimping at least one bare conductor of at least one sheathed electric wire, the at least one bare conductor being placed on a bottom plate. A pair of crimp craws extend from the bottom plate to crimp the at least one bare conductor placed on the bottom plate. A plurality of serrations are formed at least on an inner face of the bottom plate to bite the at least one bare conductor crimped by the crimp claws. At least one of the serrations has a depth different from a depth of each another serration.

U.S. Pat. No. 6,799,990 to Wendling, et al. issued Oct. 5, 2004 entitled "Crimp connector" discloses a crimp connector for electrical contacting at least one electrical conductor embedded in an insulating material. The crimp connector has a crimping region comprising a base having at least one contact strip and at least one piercing tine. The at least one contact strip has a tapered tip and is arranged on the base such that the tapered tip penetrates an insulating material of a conductor from a lower surface to contact an electrical conductor therein when crimped. The at least one piercing tine has a tapered end region and is arranged on the base such that the tapered end region penetrates the insulating material of the conductor from an upper surface to contact the electrical conductor therein when crimped.

U.S. Pat. No. 6,893,274 to Chen, et al issued May 17, 2005 and entitled "Structure of ground pin for AC inlet and process for fastening wire onto same" discloses a structure of an AC inlet that includes a main body, at least one power terminal, at least one power pin coupled with the at least one power terminal and electrically connected to a circuit board, a ground terminal for accepting a ground signal from the AC power source, and a ground pin grounded through a wire and having a first strip coupled with the ground terminal and a second strip essentially parallel with a surface of the main body. The structure is characterized in that the free end of the second strip has a notch for accommodating a bare wire end of the wire and a projecting plate inclined at an elevation angle with the second strip, and the projecting plate is pressed downwards for fastening the bare wire end.

Similarly, the use of filaments, including those of shaped memory alloy (SMA), for various purposes is also well known. SMA generally comprises a metal that is capable of "remembering" or substantially reassuming a previous geometry. For example, after it is deformed, it can either substantially regain its original geometry by itself during e.g., heating (i.e., the "one-way effect") or, at higher ambient temperatures, simply during unloading (so-called "pseudo-elasticity"). Some examples of shape memory alloys include nickel-titanium ("NiTi" or "Nitinol") alloys and copper-zinc-aluminum alloys.

SMAs often find particular utility in mechanical actuation systems, in that it can be used to replace more costly, heavy, and space-consuming solenoid, motor driven, or relay devices. For example, U.S. Pat. No. 4,551,974 to Yaeger, et al. issued on Nov. 12, 1985 and entitled "Shape memory effect actuator and methods of assembling and operating therefore" discloses a shape memory effect actuator. The actuator comprises a biasing means which is normally biased in a first position and a shape memory alloy actuator element cooperatively engaged with the biasing means. The actuator element in a first unactivated condition is biased in the first position by the biasing means. In a second unactivated condition, the actuator element biases and retains the biasing means in a second position. The actuator element in an activated condition biases the biasing means in the second position. Also disclosed is a method of assembling an actuator and a cooperating apparatus and a method of operating the actuator.

U.S. Pat. No. 4,806,815 to Honma issued on Feb. 21, 1989 and entitled "Linear motion actuator utilizing extended shape memory alloy member" discloses a linear motion actuator which has a body; a member which is movable in a linear direction with respect to the body; an extended member made of shape memory alloy material, extended in a direction transverse to that linear direction so as to intersect it, supported at its ends by the body, and coupled at its intermediate portion to the movable member at least with regard to mutual movement therebetween in that linear direction; and an element for biasing the movable member and the intermediate portion of the extended shape memory alloy member in that linear direction, so as to apply an elongation deformation to the extended shape memory alloy member.

U.S. Pat. No. 5,312,152 to Woebkenberg, Jr., et al. issued on May 17, 1994 and entitled "Shape memory metal actuated separation device" discloses a shape memory alloy (SMA) actuator pre-deformed in tension that actuates a separation device mechanism. A segmented nut, which engages a threaded bolt to be held and released, is held together by a nut retainer that is movable with respect to the nut and is affixed to the SMA element. The SMA element is heated by an electrical resistance heater to cause it to return to its undeformed state, thereby moving the retainer relative to the nut segments. When the retainer disengages from the segments, the segments are free to move outwardly thereby releasing the bolt or other item. Ones of the shape memory alloy actuator have a plurality of parallelly arranged SMA elements, every other one of which is pre-deformed in compression and intermediate ones of which are predeformed in tension. The elements are coupled end-to-end so that, when they are heated to cause them to return to their un-deformed states, their respective elongations and shrinkages combine at the output to produce an actuation that is the cumulation in the same direction of the changes of all the elements. The plurality of elements may be in a side-by-side or concentric arrangement. Embodiments of the separation nut also include a plunger arrangement for urging the nut segments to move apart when released by the nut retainer and an ejector for pushing the released bolt or other item out of the separation device housing.

U.S. Pat. No. 5,440,193 to Barrett issued on Aug. 8, 1995 and entitled "Method and apparatus for structural, actuation and sensing in a desired direction" discloses an apparatus, system and method for actuating or sensing strains in a substrate which includes at least one actuator/sensor element which has transverse and longitudinal axes. The actuator/sensor element is attached to the substrate in such a manner that the stiffness of the actuator/sensor element differs in the transverse and longitudinal axes. In this manner, it is possible to sense or actuate strains in the substrate in a desired direction, regardless of the passive stiffness properties of the substrate, actuator element or sensor element. An isotropic actuator/sensor element attached to a substrate in this manner can then operate in an anisotropic way. In a preferred embodiment, the actuator/sensor element is bonded to the substrate at an area of attachment occupying only the central third of the actuator/sensor element in its longitudinal axes. The actuator/sensor element may be a piezoelectric, magnetostrictive, thermally actuated lamina (including bi-metallic) or shape memory alloy element.

U.S. Pat. No. 5,563,466 to Rennex, et al. issued on Oct. 8, 1996 and entitled "Micro-actuator" discloses micro-machining fabrication techniques to achieve practical electrostatic actuation forces over a length change of the order of 20 to 50 percent. One basic design utilizes diamond-shaped attractive elements to transmit transverse forces for longitudinal, two-way actuation. Another basic design features interlocking, longitudinally attractive elements to achieve longitudinal, two-way actuation. Other improvements include means for locking the actuator at an arbitrary displacement as well as means for amplification of either the actuation force or length change.

U.S. Pat. No. 5,685,148 to Robert issued Nov. 11, 1997 and entitled "Drive apparatus" discloses a drive apparatus for reversible movements of an actuator with a drive element made from a shape memory alloy with one-way effect. The drive element acts upon a lever rotatable about an axle in opposition to the force of a resetting element, wherein the lever can be used as a coupling member for converting a deformation of the drive element into a movement of the actuator. The drive element is a winding with a plurality of turns of a wire, wherein the turns are fixed and arranged mechanically parallel between an anchor point and the lever so that the lever is rotatable about the axle by means of a deformation of a turn, and the tractive force acting upon the lever by means of the drive element results from the individual forces of the turns of the winding acting mechanically parallel upon the lever. The diameter of the wire is advantageously approximately equal to the standardized diameter of the crystalline grain of the shape memory alloy in the austenitic state.

U.S. Pat. No. 5,763,979 to Mukherjee, et al. issued on Jun. 9, 1998 and entitled "Actuation system for the control of multiple shape memory alloy elements" discloses an actuation system for the control of multiple shape memory alloy elements that is achieved by arranging the shape memory actuators into a matrix comprised of rows and columns which results in approximate a fifty percent reduction in the number of electrical connecting wires. This method of actuation provides the scope for resistance measurements of the shape memory alloy actuators and therefore feedback control of the actuators can be accomplished without additional wires.

U.S. Pat. No. 5,870,007 to Carr, et al. issued on Feb. 9, 1999 to "Multi-dimensional physical actuation of microstructures" discloses a microstructure that includes a substrate and a movable platform which is tethered by a first cantilever arm to the substrate. The first cantilever arm is comprised of a sandwich of first and second materials, the first and second materials exhibiting either different thermal coefficients of expansion or a piezoelectric layer. A second cantilever arm includes a first end which is tethered to the platform and a free distal end which is positioned to engage the substrate. The second cantilever arm is constructed similarly to the first cantilever arm. A controller enables movement of the platform through application of signals to both the first cantilever arm and the second cantilever arm to cause flexures of both thereof. The second cantilever arm, through engagement of its free end with the substrate, aids the action of the first cantilever arm in moving the platform. Further embodiments include additional cantilever arms which are independently controllable to enable multiple ranges of movement of the platform by selective actuation of the cantilever arms; and plural opposed cantilever arms that are connected between the substrate and the platform, but are independently controllable to achieve complex modes of movement of the platform. A further embodiment includes plural actuation regions within each cantilever arm to enable countermovements of each cantilever arm to be achieved.

U.S. Pat. No. 6,236,300 to Minners issued on May 22, 2001 and entitled "Bistable micro-switch and method of manufacturing the same" discloses a bistable switch using a shape memory alloy, and a method for manufacturing the same. More specifically, the bistable switch includes a substrate having at least one power source; a flexible sheet having a first distal end attached to the substrate; a bridge contact formed at a second and opposite distal end of the flexible sheet; and at least one heat activated element connected to a first surface of the flexible sheet and between the second distal end and the power source. During operation, current from the power source passing through the heat activated element to indirectly bend the flexible sheet and short the signal contacts on the substrate with a sustainable force.

U.S. Pat. No. 6,326,707 to Gummin, et al. issued on Dec. 4, 2001 and entitled "Shape memory alloy actuator" discloses a linear actuator that includes a plurality of sub-modules disposed in adjacent array and adapted to translate reciprocally parallel to a common axis. A plurality of shape memory alloy wires extend generally linearly and parallel to the axis, and are each connected from one end of a sub-module to the opposed end of an adjacent sub-module. The SMA wires are connected in a circuit for ohmic heating that contracts the SMA wires between the sub-modules. The sub-modules are linked by the SMA wires in a serial mechanical connection that combines the constriction stroke displacement of the SMA wires in additive fashion to achieve a long output stroke. Moreover, the sub-modules are assembled in a small volume, resulting in an actuator of minimal size and maximum stroke displacement. The sub-modules may be rods or bars disposed in closely spaced adjacent relationship, or concentric motive elements, with the serial mechanical connection extending from each motive element to the radially inwardly adjacent motive element, whereby the innermost motive element receives the sum of the translational excursions of all the motive elements concentric to the innermost element. The SMA linear actuator includes a restoring spring assembly having a restoring force that decreases with increasing displacement to minimize residual strain in the SMA components. The SMA wires are connected for ohmic heating in various series and parallel circuit arrangements that optimize force output, cycle time, current flow, and ease of connection.

U.S. Pat. No. 6,379,393 to Mavroidis, et al. issued on Apr. 30, 2002 and entitled "Prosthetic, orthotic, and other rehabilitative robotic assistive devices actuated by smart materials" discloses medical devices using smart materials and related emerging technologies under development for robotics. In particular, the invention is directed to the development of rehabilitative (i.e. prosthetic, orthotic, surgical) devices actuated by smart material artificial muscles to increase the dexterity and agility of an artificial limb or a dysfunctional body part, so that movement of the limb more accurately simulates movement of a human appendage. A kinetic assistive device is provided is provided which is constructed of a lightweight material (such as aluminum) and has a plurality of smart material actuators attached thereto.

U.S. Pat. No. 6,425,829 to Julien issued on Jul. 30, 2002 and entitled "Threaded load transferring attachment" discloses a Nitinol element which is threaded by first heating it to a temperature of about 800 C., and then applying a threading tool, such as a tap or die, to form the threads. Nitinol has a unique property of increasing yield strength as cold work is applied, but this property ceases to exist above a temperature of about 800 C. The strength of the material at this temperature, however, is sufficient to resist the torque applied by a threading die being screwed onto a Nitinol blank even though it is low enough to permit the Nitinol to flow when the cutting threads of the threading die are forced into the material. At this temperature, the Nitinol is not actually cut by the cutting threads of the tap, die or other threading tool, but instead, the material flows around the cutting threads to form threads in the Nitinol. Since the metal flows into spaces between the threads of the "cutting" or forming tool, it is necessary to use slightly undersized rod or slightly oversized holes when using conventional dies and taps since no chips are removed.

U.S. Pat. No. 6,574,958 to MacGregor issued on Jun. 10, 2003 and entitled "Shape memory alloy actuators and control methods" discloses stroke-multiplying shape memory alloy actuators and other actuators using electromechanically active materials [collectively referred to in this application as SMA actuators] providing stroke multiplication without significant force reduction, that are readily miniaturizable and fast acting, and their design and use; economical and efficient control and sensing mechanisms for shape memory alloy actuators (including conventional shape memory alloy actuators as well as the stroke-multiplying SMA actuators of this invention) for low power consumption, resistance/obstacle/load sensing, and accurate positional control; and devices containing these actuators and control and sensing mechanisms.

U.S. Pat. No. 6,832,477 to Gummin, et al. issued on Dec. 21, 2004 and entitled "Shape memory alloy actuator" discloses actuators that employ a shape memory alloy component as the driving element include linear and rotational devices. An Intrinsic Return Means (IRM) may be imparted to the SMA actuator, thereby reducing the use of a spring return mechanism. The rotational actuator may include a cylindrical bobbin with a helical groove to receive an SMA wire. A number of turns may be placed in a small length of bobbin to amplify the rotational excursion. In another rotational actuator, a plurality of narrow, coaxial rings are provided, the rings being nested in close concentric fit or stacked in side-by-side fashion. Each ring is provided with a groove extending thereabout to receive an SMA wire and contraction of the wire causes each ring to rotate with respect to the adjacent ring. In an embodiment for linear actuation, the invention provides a bar-like component having SMA wires joined between bars. The invention includes a lost motion coupling to join two counter-acting SMA stroke amplification devices, whether linear or rotational.

U.S. Patent Publication No. 20020185932 to Gummin, et al. published on Dec. 12, 2002 and entitled "Shape memory alloy actuator" discloses actuators that employ a shape memory alloy component as the driving element include linear and rotational devices. An Intrinsic Return Means (IRM) may be imparted to the SMA actuator, thereby reducing the use of a spring return mechanism. The rotational actuator may include a cylindrical bobbin with a helical groove to receive an SMA wire. A number of turns may be placed in a small length of bobbin to amplify the rotational excursion. In another rotational actuator, a plurality of narrow, coaxial rings are provided, the rings being nested in close concentric fit or stacked in side-by-side fashion. Each ring is provided with a groove extending thereabout to receive an SMA wire and contraction of the wire causes each ring to rotate with respect to the adjacent ring. In an embodiment for linear actuation, the invention provides a bar-like component having SMA wires joined between bars. The invention includes a lost motion coupling to join two counter-acting SMA stroke amplification devices, whether linear or rotational.

U.S. Patent Publication No. 20040256920 to Gummin, et al. published on Dec. 23, 2004 entitled "Shape memory alloy actuators" discloses linear actuators comprised of a plurality of geometric links connected together in displacement multiplied fashion by a plurality of SMA wires. The links may have a trigon or chevron configuration. The trigon links may be combined with a hexagonal or rhomboidal shaft to create a defined stacking pattern of links about the shaft. The shaft extends from the medial portion of the stack. Ohmic heating circuits connect to non-moving ends of SMA wires. Various groupings of links in parallel displacement are described.

U.S. Patent Publication No. 20050229670 to Perreault, published on Oct. 20, 2005 and entitled "Stent crimper" discloses an apparatus for applying an inward force to a medical device may include at least two independently operable sections. Each section may include a plurality of movable blades arranged to form an aperture or chamber whose size may be varied. Each blade may be pivotally connected to a mount and slidably engaged with a constraining member. The blades are movable so as to allow the aperture to be sized to contain the medical device and to alter the size of the aperture.

U.S. Patent Publication No. 20050273020 to Whittaker, et al. published on Dec. 8, 2005 and entitled "Vascular guidewire system" discloses a vascular guidewire in an embodiment of the present invention, having such features as uniform diameter, low-profile cross section over its length and a distal tip capable of deflection and variable configurations, provides a range of advantages. A variable distal tip of shape-memory alloy deflects into varied configurations when remotely actuated. Such actuation, according to an aspect of the present invention, can be by way of a side entry, easily repositioned, single-handed controller that allows both rotational control of the guidewire and control of the variable tip. In another aspect, a longitudinal element in the guidewire, such as an exterior wire wrap, can provide dual functionality, including structural support as well as an electrical path for use in energizing, and thus deflecting, the distal tip. In yet another aspect, the overall guidewire geometry having constant circumference and low profile, as well as side-access controllability, permits advantageous coaxial mounting and removal of catheters over the proximal guidewire end and facilitates insertion and removal of guidewires through catheters in vivo.

U.S. Patent Publication No. 20050273059 to Mernoe, et al. published Dec. 8, 2005 and entitled "Disposable, wearable insulin dispensing device, a combination of such a device and a programming controller and a method of controlling the operation of such a device" discloses a disposable, wearable, self-contained insulin dispensing device includes a housing and an insulin source in the housing that is connected to a catheter for injecting insulin into a user. The catheter projects generally perpendicularly to a generally planar surface of the housing configured for abutting a skin surface of the user; which planar surface includes an adhesive layer for adhering the housing surface to the skin surface. A removable release sheet covers the adhesive layer for protecting the adhesive layer prior to use of the device. The release sheet is provided with a catheter protection element to enclose and protect an end portion of the catheter, such that removal of the release sheet for exposing the adhesive layer also exposes the end portion. A pump in the housing includes an actuator employing a shape memory alloy wire.

Deficiencies of the Prior Art

Despite the broad range of crimp technologies and implementations of SMA filaments, there has heretofore been significant difficulty in effectively crimping SMA filament wire when finer wire gauge sizes are chosen. Specifically, prior art approaches to crimping such filaments (including use of serrations or "teeth" in the crimp surfaces) either significantly distort or damage the filament, thereby altering its mechanical characteristics in a deleterious fashion (e.g., reducing its tensile strength or recovery properties), or allowing it to slip or move within the crimp. These problems are often exacerbated by changes in the environment (e.g., temperature, stress, etc.) of the SMA filament and crimp. Other techniques such as brazing, soldering, and the like are also not suitable for such fine-gauge applications.

Furthermore, no suitable solution exists for maintaining a constant and uniform tensile stress on the filament during crimping. Typical SMAs such as Nitinol can recover stress induced strain by up to about eight (8) percent. Therefore, in applications where filament length is relatively small, it is critical to maintain accurate spacing of the end crimping elements connected by the SMA wire after completion of the crimping process.

There is, therefore, a salient unsatisfied need for an improved crimp apparatus and methods of manufacture that specifically accommodate finer gauge SMA filament wire assemblies, especially so as to maintain the desired degree of filament length control post-crimp for, inter alia, length-critical actuator applications.

In addition, improved apparatus and methods for the manufacture and packaging of SMA wire assemblies are also needed in order to maintain these precision assemblies cost-effective and competitive from a manufacturing perspective. Such improved manufacture and packaging approaches would also ideally be compatible with extant industry-standard equipment and techniques to the maximum degree practicable, thereby minimizing the degree of infrastructure and equipment alterations and upgrades necessary to implement the technology.

SUMMARY OF THE INVENTION

The invention satisfies the aforementioned needs by providing an improved crimp apparatus and methods that are particularly useful with smaller gauge filaments (e.g., SMA wire). In addition, machines and methods for the automated manufacture of such assemblies are also disclosed.

In a first aspect of the invention, a filament crimping element is disclosed. In one embodiment, the element comprises: a first plurality of cavities, the first set of cavities disposed at a spacing which creates a first plurality of features; and a second plurality of cavities, the second set of cavities disposed at a spacing which creates a second plurality of features; wherein the first and second pluralities of cavities are substantially opposite one another when the crimping element is crimped, the first plurality of features adapted to be placed at least partially within the second plurality of cavities and the second plurality of features adapted to be placed at least partially within the first plurality of cavities. In one variant, the first and second pluralities of cavities and features form a substantially serpentine channel therebetween for the filament when the crimping element is crimped. In another variant, at least one of each of the first and second pluralities of features comprises substantially rounded edges, the substantially rounded edges mitigating deformation of at least a portion of the filament during crimping.

In still another variant, the crimping element is formed from a material which has a hardness less than that of the filament, the lesser hardness of the material at least mitigating deformation of the filament by the crimping element during crimping.

In another embodiment, the filament crimping element comprises: a first plurality of cavities, the first plurality of cavities disposed at a spacing which creates a first plurality of features; and a second plurality of cavities, the second plurality of cavities disposed at a spacing which creates a second plurality of features. The first and second pluralities of cavities are substantially opposite to yet substantially offset from one another when the crimping element is crimped; and the first and second pluralities of cavities and features form a substantially serpentine channel therebetween for receiving the filament when the crimping element is crimped.

In yet another embodiment, the filament crimping element comprises: a first substantially planar portion having a first face; a second substantially planar portion having a second face; a fold region coupling the first and second substantially planar portions, the fold region being adapted to allow the first and second faces to be disposed substantially opposite one another during a crimping operation; at least one first raised feature disposed substantially on the first face; and at least one second raised feature disposed substantially on the second face. The at least one first and second features are substantially opposite to yet substantially offset from one another when the crimping element is crimped.

In a second aspect of the invention, apparatus for the automated manufacture of filament crimp apparatus is disclosed. In one embodiment, the apparatus for automated manufacture comprises: apparatus configured to present a plurality of crimping elements; a tensioning station, the tensioning station adapted to keep a filament wire under a tension during at least a portion of a crimping process; and a crimping apparatus, the crimping apparatus adapted to crimp at least one of the crimping elements to the filament wire under tension to produce one or more of the filament crimp apparatus.

In one variant, the apparatus configured to present comprises a de-reeling station, the de-reeling station comprising a plurality of crimp element carrier assemblies.

In another variant, the crimping elements are each joined together to at least one other crimping element, and the apparatus further comprises a singulation station, the singulation station adapted to singulate the crimp elements from one another.

In a third aspect of the invention, a crimped filament assembly is disclosed. In one embodiment, the assembly comprises: at least one crimp element assembly, the at least one element assembly comprising: a plurality of crimp heads, each of the crimp heads comprising a metal alloy with a plurality of crimping cavities therein, the plurality of crimping cavities adapted to retain a filament wire therein; and a filament wire, the filament wire crimped to at least two of the crimp heads; and a carrier; the carrier adapted to locate the at least one crimp element assembly.

In a fourth aspect of the invention, a method for manufacturing a crimp element carrier assembly is disclosed. In one embodiment, the method comprises: providing a plurality of crimp elements; disposing a filament wire proximate at least one of the plurality of crimp elements; crimping the filament wire under tension to the at least one of the plurality of crimp elements to form a crimped assembly; and placing the crimped assembly onto a carrier.

In a fifth aspect of the invention, a method of crimping a fine-gauge filament is disclosed. In one embodiment, the method comprises: providing a filament; providing a crimp element having substantially offsetting features; and deforming the filament into a substantially serpentine shape within the substantially offsetting features of the crimp element.

In a sixth aspect of the invention, a method for manufacturing crimp element assemblies is disclosed. In one embodiment, the method comprises: providing a plurality of crimp elements; disposing a filament wire proximate at least two of the plurality of crimp elements; crimping the filament wire to the at least two of the plurality of crimp elements; and severing the filament between the at least two crimp elements so as to form at least two crimp element assemblies.

BRIEF DESCRIPTION OF THE DRAWINGS

The features, objectives, and advantages of the invention will become more apparent from the detailed description set forth below when taken in conjunction with the drawings, wherein.

DETAILED DESCRIPTION OF THE PREFERRED EMBODIMENT

Figure 1:
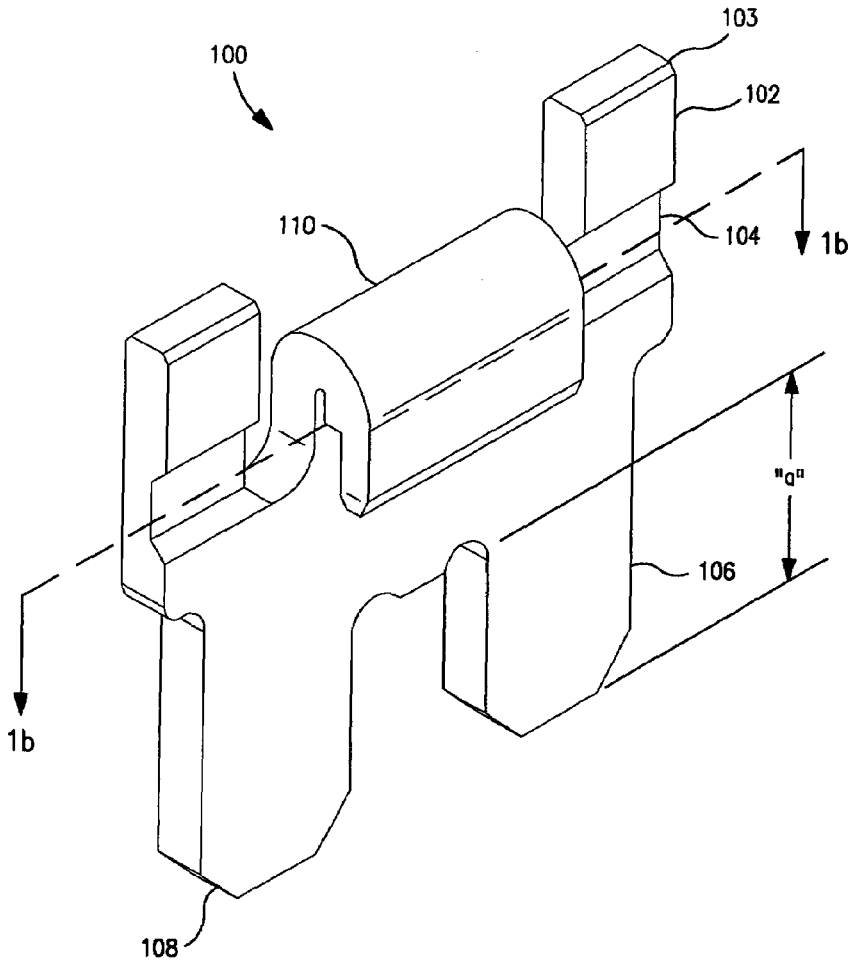
FIG. 1 is a perspective view of a first exemplary embodiment illustrating a folded (end) crimp element according to the principles of the present invention.

Reference is now made to the drawings wherein like numerals refer to like parts throughout.

As used herein, the term "shape memory alloy" or "SMA" shall be understood to include, but not be limited to, any metal that is capable of "remembering" or substantially reassuming a previous geometry. For example, after it is deformed, it can either substantially regain its original geometry by itself during e.g., heating (i.e., the "one-way effect") or, at higher ambient temperatures, simply during unloading (so-called "pseudo-elasticity"). Some examples of shape memory alloys include nickel-titanium ("NiTi" or "Nitinol") alloys and copper-zinc-aluminum alloys.

As used herein, the term "filament" refers to any substantially elongate body, form, strand, or collection of the foregoing, including without limitation drawn, extruded or stranded wires or fibers, whether metallic or otherwise.

As used herein, the term "progressive stamping" shall be understood to include any metalworking method including, without limitation, punching, coining, bending or any other method of modifying or otherwise changing metal raw material. Such stamping may be combined with an automatic feeding system.

As used herein, the term "controller" refers to, without limitation, any hardware, software, and or firmware implementation of control logic, algorithm, or apparatus adapted to control the operation of one or more component of a machine or device, or step(s) of a method.

As used herein, the term "computer program" is meant to include any sequence or human or machine cognizable steps which perform a function. Such program may be rendered in virtually any programming language or environment including, for example, C/C++, Fortran, COBOL, PASCAL, assembly language, markup languages (e.g., HTML, SGML, XML, VoXML), and the like, as well as object-oriented environments such as the Common Object Request Broker Architecture (CORBA), Java™ (including J2ME, Java Beans, etc.) and the like.

As used herein, the terms "processor" and "microcontroller" are meant to include any integrated circuit or other electronic device (or collection of devices) capable of performing an operation on at least one instruction including, without limitation, reduced instruction set core (RISC) processors, CISC microprocessors, microcontroller units (MCUs), CISC-based central processing units (CPUs), and digital signal processors (DSPs). The hardware of such devices may be integrated onto a single substrate (e.g., silicon "die"), or distributed among two or more substrates. Furthermore, various functional aspects of the processor may be implemented solely as software or firmware associated with the processor.

Overview

In one salient aspect, the present invention discloses improved crimp apparatus and methods useful in variety of applications including, inter alia, crimping fine-gauge SMA (e.g., Nitinol) wire. This apparatus provides a cost-effective, easy to use, and effective way of fastening such fine-gauge wires so that desired strength and other mechanical properties (including maintaining precise length relationships after crimping) are preserved. These properties can be critical to precision applications of such crimped fine-gauge wire, such as in medical device actuators.

Key to maintaining these properties is the use of a novel crimp geometry, which in effect "kinks" the filament without any significant intrusion or filament over-compression, thereby locking the filament in place with respect to the crimp.

The material chosen for the crimp element of one exemplary embodiment is also softer than that of the filament being crimped (e.g., SMA), thereby mitigating or eliminating any damage to the filament which would otherwise reduce its strength (and the strength of the crimp as a whole).

The foregoing features (i.e., choice of material hardness and properties, and filament geometry or "kink") also cooperate in a synergistic fashion to make the crimp stronger and more reliable than prior art approaches.

In one embodiment, a desired level of tension is maintained on the filament during the crimp process, which helps preserve the desired length relationships of the SMA filament post-crimping.

In another aspect of the invention, improved apparatus for processing the aforementioned crimp apparatus, in order to manufacture precision crimp and wire assemblies, is disclosed. In one variant, the apparatus comprises a substantially automated machine having a plurality of functional modules or stations therein. Crimp element assemblies are fed into the machine, which automatically aligns these assemblies, places the filament within the crimp heads of the crimp elements, and then crimps the filaments under tension to produce final assemblies which have the aforementioned desirable mechanical properties.

Methods of manufacturing including those using the aforementioned apparatus are also described in detail.

Filament Crimping Apparatus

Figure 2:
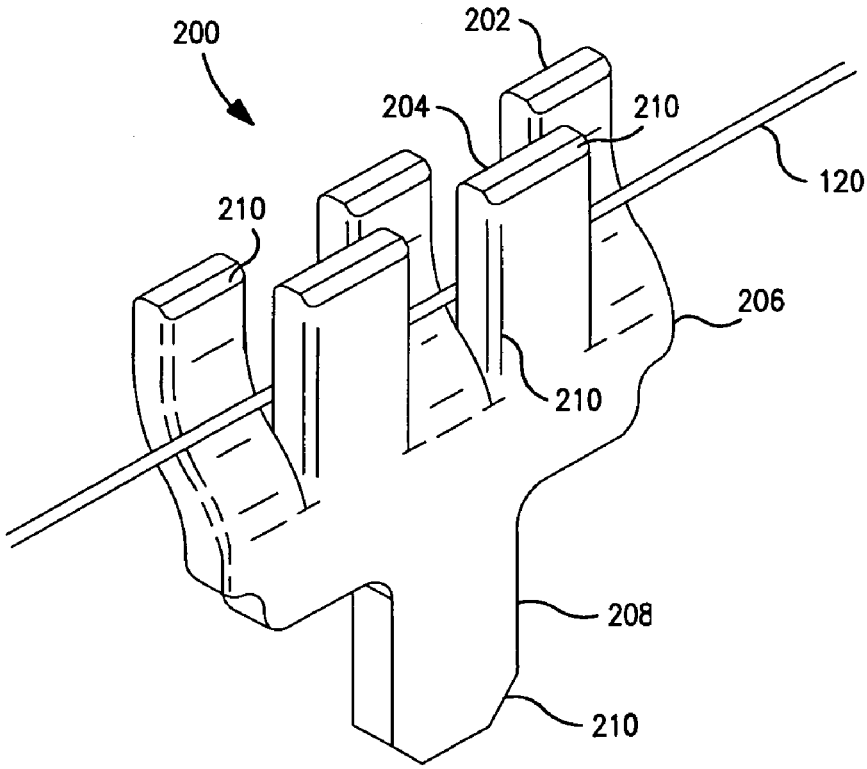
FIG. 2 is a perspective view of another exemplary embodiment of the head portion of the crimp element according to the principles of the present invention.
Figure 2A:
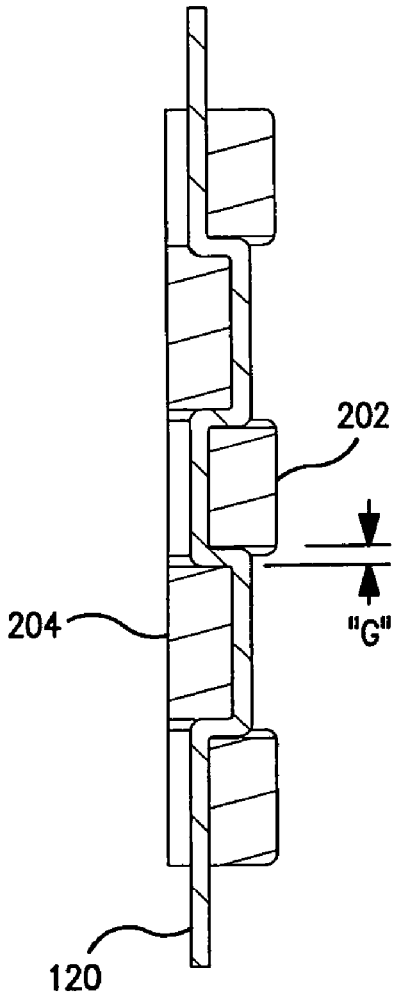
FIG. 2*a* is a top view showing the exemplary embodiment of the crimp element of FIG. 2 as fully crimped.

Referring now to FIGS. 1 through 2*a*, various embodiments of the crimp apparatus according to the present invention are described in detail. It will be appreciated by those of ordinary skill when provided this disclosure that still other variants and configurations of crimp apparatus may be utilized consistent with the invention, and hence the present disclosure and the claims appended hereto are in no way limited to the illustrated and described embodiments.

FIG. 1 shows a first embodiment of an "end" crimp element 100, having a pre-formed head crimp element 110. As used herein, the term "end" is merely intended in a relative sense, in that one embodiment of the invention (see FIG. 1*g*) places two of these elements 100 at respective ends of a larger assembly 150. The end elements 100 disclosed herein can therefore be disposed at literally any location within an assembly, or even be used alone.

The end crimp element 100 of the illustrated embodiment generally comprises a metal alloy having a plurality of arm elements 102, leg elements 106, and a head element 110. The metal alloy of the element 100 itself comprises a copper based alloy (such as, C26000 70/30 "cartridge brass", or UNS C51000), post plated with a tin-lead ("Sn—Pb") overplate, although any number of conventional material and plating choices could be substituted consistent with the principles of the present invention. While the present invention is generally contemplated for use with shape memory alloy (SMA) filaments, other fine gauge filament wires or elongate structures could also be used consistent with the principles of the present invention.

As previously noted, the use of a material that is softer than the filament being crimped (e.g., SMA) also advantageously avoids damage to the fine-gauge filament, thereby enhancing the strength of the filament and the crimp as a whole (as compared to prior art techniques which substantially cut into or deform the filament).

In a related fashion, the proper selection of materials and the design of the crimp head (described below) further avoid any significant deformation of the filament (e.g., reduction in its thickness/diameter, or alteration of its cross-sectional shape) that could also weaken the strength of the filament and the crimp as a whole.

It will be recognized that the terms "arm", "leg" and "head" as used herein are merely a convenient reference (in effect anthropomorphizing the element 100), and hence no particular orientation or placement of the element 100 or the individual components 102, 110, 106 is required to practice the invention. For example, as shown in FIG. 1*g*, the elements 100 may be placed in mirror-image disposition to one another, may be laid flat, used inverted, etc.

The exemplary end crimp element 100 of FIG. 1 is manufactured using a flat stock (e.g. 0.3 mm) that is stamped using standard manufacturing processes, such as e.g. progressive stamping or even hand stamping using a pneumatic press. The stamping should preferably be performed from the front side to the back (the front side being the near side of the device shown in FIG. 1) so as to minimize the chance that burrs, etc. could cause damage to the resultantly placed filament wire 120 (FIG. 1*g*). Although stamping is considered exemplary due to considerations such as cost and dimensional accuracy in high volume production runs, other manufacturing methods such as e.g., photochemical machining or even laser/ion beam cutting techniques could be utilized as well consistent with the principles of the present invention. The use of photochemical machining is advantageous in smaller run quantities as initial investment costs to produce the tools necessary to create the desired geometries are minimal. The manufacture of precision metal parts is well understood in the mechanical arts, and as such will not be discussed further herein.

Referring again to FIG. 1, the "arm" elements 102 generally comprise a minimum width of approximately twice (2×) the base material thickness, although other shapes and thicknesses can be chosen depending on the particular application. A cavity or channel 104 is formed via either the aforementioned stamping, photochemical machining, or other processes which provides clearance for the crimped filament (not shown). For example, if the filament comprises an SMA, then providing clearance outside of the crimp location permits the free movement of the SMA filament without any resultant friction associated with a tangential surface of the filament coming into contact with a respective face of the end crimp element 100. It also allows the wire to be straight and maintain its active length, and also maintain a desired electrical resistance value. Such a gap 104 can generally improve SMA actuator efficiency.

Also, it will be noted that the end crimp element 100 of FIG. 1 comprises two (2) arm elements 102. In the present embodiment, two arms 102 are included for purposes of symmetry, and so that the single end crimping element 100 could be utilized in either left-handed or right-handed applications. Any number of different configurations of the arm elements 102 (including none, a single arm, or even more then two arms) could be utilized consistent with the principles of the present invention. Optional chamferring 103 is included to reduce the likelihood that a sharp edge could result in cuts to either an individual utilizing the present invention or alternatively, any other proximate electrical or mechanical components. Furthermore, other surfaces than those shown in FIG. 1 may be chamfered or otherwise processed (e.g., mechanically polished, de-burred, etc.) in order to achieve these goals.

The "leg" elements 106 of the end element 100 generally comprise a post with chamfered lead features 108. The legs 106 are characterized by their length "a" which is the insertion depth of the feature into a respective receptacle (not shown) or via a through-hole mounting. Although depicted in an arrangement for use as a plug or through-hole mounted device, the legs 106 of the device 100 could easily be altered for other configurations such as e.g. surface-mounting or self-leading. The use of surface mounted leads is well known in the electronic arts, and can be readily implemented with the present invention by those of ordinary skill given the present disclosure.

Figure 1A:
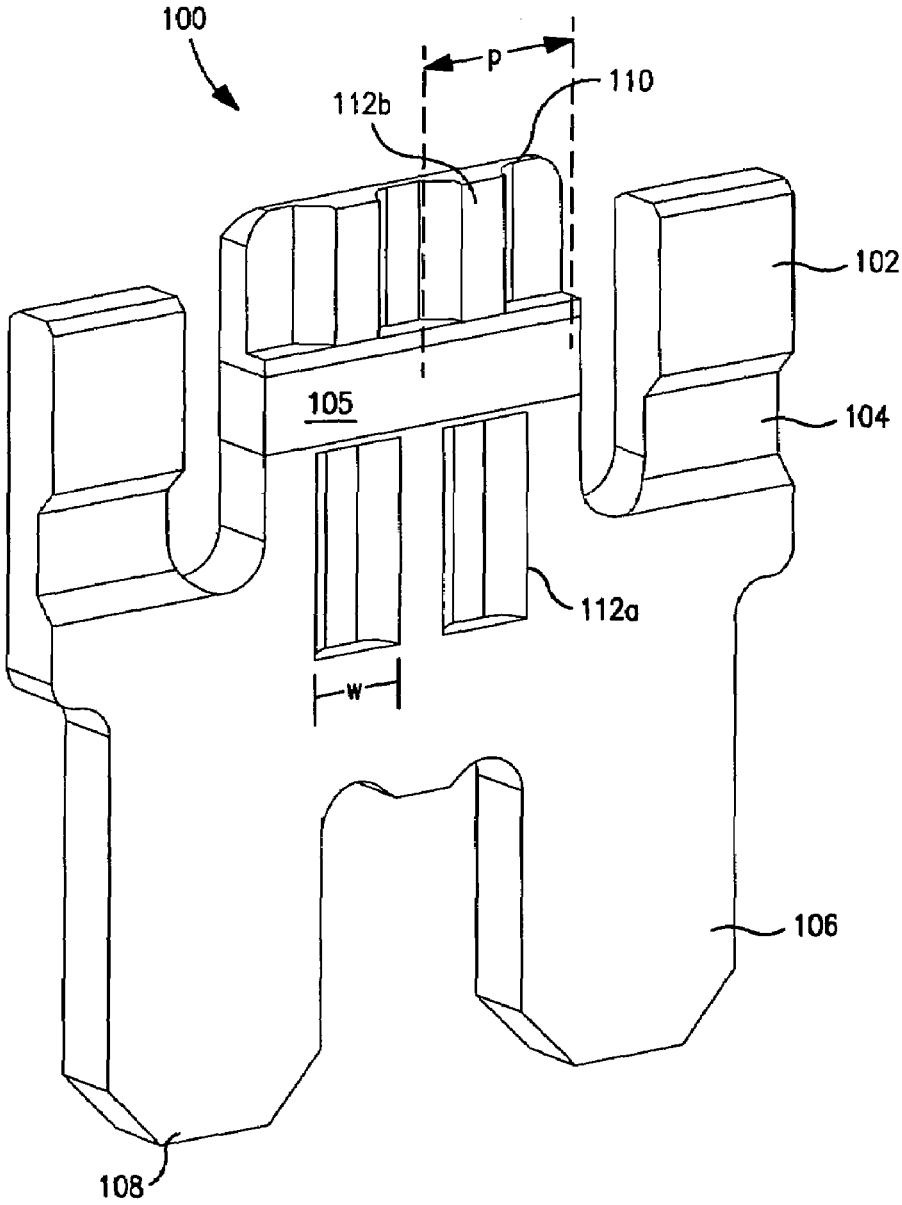
FIG. 1*a* is a perspective view showing an unfolded crimp element of FIG. 1.

Referring now to FIG. 1*a*, an unfolded representation (i.e., a version where the head element 110 has not been yet folded) of the end crimp element 100 of FIG. 1 is disclosed and shown. Of particular interest are the various features of the head element 110. Specifically, head element 110 contains a plurality of cavities 112*a* and the resultant ribs 112*b* formed by the creation of such cavities. These features 112*a*, 112*b* are advantageously formed using a conventional high-speed stamping process, although other methods, such as e.g., pneumatic or hand-operated press, or the aforementioned photochemical machining processes, could be used. In the embodiment shown in FIG. 1*a*, the head element comprises five (5) cavities 112*a* and three (3) ribs 112*b*, although more or less cavities 112*a* and ribs 112*b* could be utilized depending on design constraints or desired attributes such as e.g. filament retention strength, width of the head element 110, etc. The aforementioned five-cavity design has been shown during testing by the Assignee hereof to work well with wire filament sizes down to approximately 0.002 inches (0.05 mm) with a material thickness of about 0.012 inches (0.3 mm).

Cavity pitch dimension ("p") and cavity width ("w") can also be important considerations when designing the end crimp element 100. Dimensions "p" and "w" should be adjusted so that when crimped (as shown in FIG. 1), the filament does not become over-compressed during the crimping process, thereby resulting in a broken or damaged filament.

As shown in FIG. 1*a*, the exemplary configuration of the crimp element 100 also includes a substantial planar (when unfolded, as shown), solid region 105 between the cavities 122 and the head element 110 that is used to receive the bend or fold of the element 100 when the filament is crimped. This region 105 is aligned with the other features of the element 100 (cavities 112*s*, ribs 112*b*, and channels 104) so that the filament is properly placed and vertically aligned with respect to these elements (and the bend) when the element 100 is crimped.

The exemplary embodiment of the crimp element also optionally includes one or more substantially planar (e.g., flat) surfaces disposed somewhere on the body, arms, legs, etc. in order to facilitate pickup by a vacuum pick-and-place or other comparable apparatus. For example, in the embodiment of FIG. 1*a*, the planar areas disposed proximate the channel 104 on the arms 102 can each be used for this purpose, although it will be appreciated that such area(s) may be placed literally on any surface of the element 100.

Figure 1B:
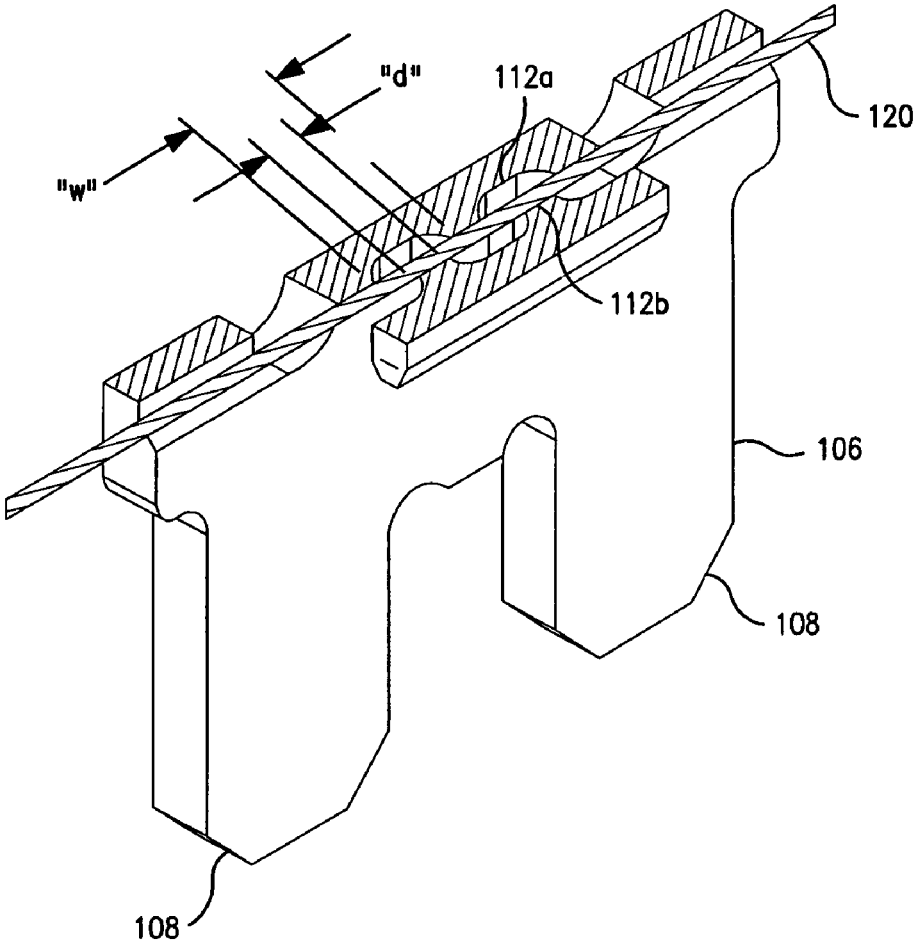
FIG. 1*b* is a cross-sectional perspective view of a folded crimp element of FIG. 1 prior to being fully crimped, taken along line 1*b*-1*b*.
Figure 1C:
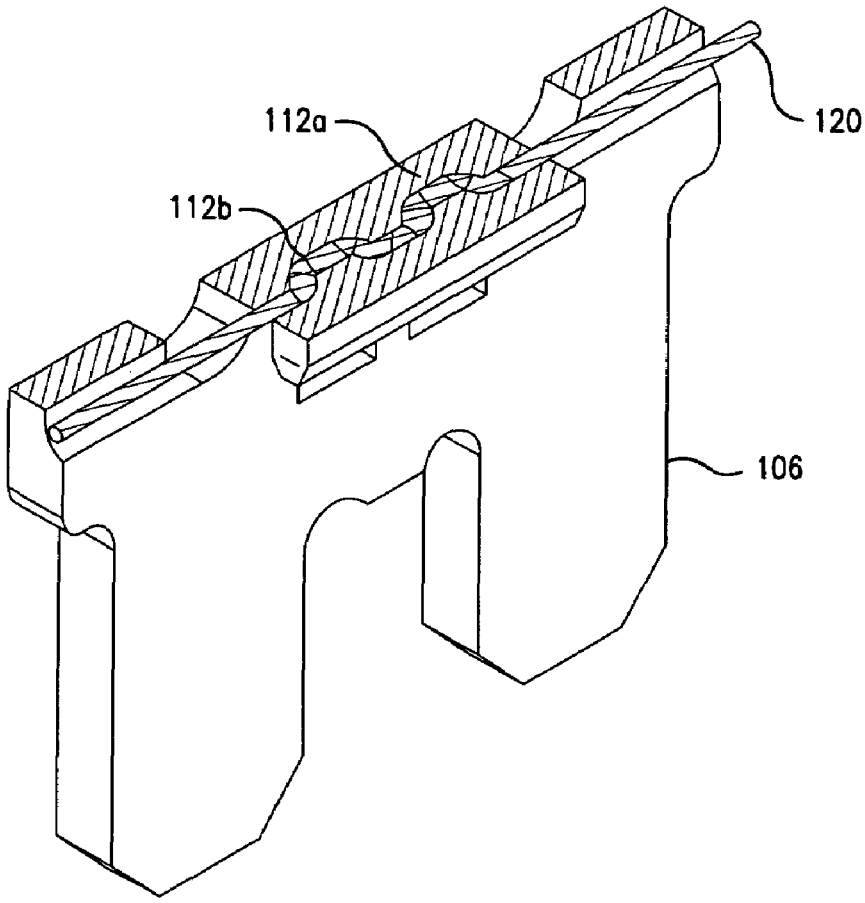
FIG. 1*c* is a cross-sectional perspective view of a fully crimped end crimp element of FIG. 1, taken along line 1*b*-1*b*.

Referring now to FIG. 1*b*, a cross-sectional view of the first embodiment of the crimp element 100 described in FIG. 1 is provided, showing a filament 120 proximate the crimping cavities 112*a*, 112*b* after the crimp has been pre-formed and just prior to being fully crimped. Of particular interest are inner and outer cavity dimensions, "d" and "w", respectively, where the pitch "p" is characterized by the equation "p=d+w". As can be seen in FIG. 1*c*, when fully crimped, the filament fits substantially "kinked" or deformed into the serpentine-shaped cavity created by features 112*a* and 112*b*, so that the filament 120 does not become over-compressed, yet becomes firmly secured within the crimped head element 110. The filament 120 thereby becomes essentially fixed in the end crimp element 100 without having to compromise the integrity of the filament 120 due to over-compression of the filament wire 120 (e.g., without substantially deforming the filament 120).

As used herein, the term "serpentine" broadly refers to, without limitation, any alternating, wave (sinusoidal, square, triangular, or otherwise), or displaced shapes or form part of or formed within a component such as a filament. Such alternating features, shapes or displacements may be, e.g., in one dimension, or two or more dimensions, relative to a generally longitudinal dimension of the filament. Furthermore, such features, shapes or displacements may be substantially regular or irregular It will be recognized that the cavities 112*a* and ribs 112*b* of the exemplary embodiment also purposely do not project along their longitudinal axis into the bend or fold region 105 of the 110 element; this acts to increase the strength of the fold when ultimately crimped.

Figure 1D:
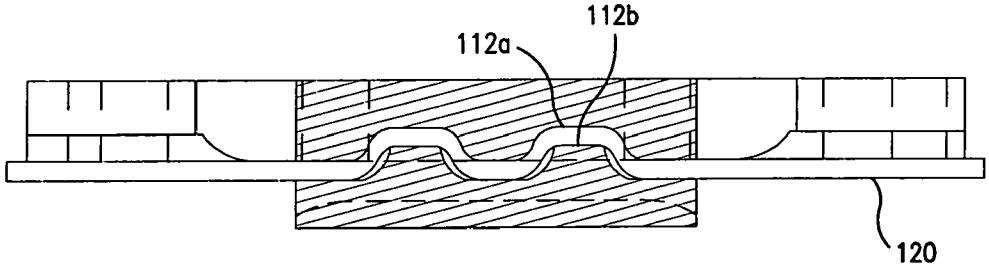
FIG. 1*d* is a top view showing the cross-section of FIG. 1*c*.

As shown best in FIGS. 1*a* and 1*d*, the edges of the ribs and cavities of the exemplary embodiment are also radiused or rounded, so as to avoid sharp edges which might unduly cut or penetrate the filament being crimped, thereby strengthening the crimp as a whole.

FIG. 1*d* shows a top view of the cross-section of FIG. 1*c*.

Figure 1E:
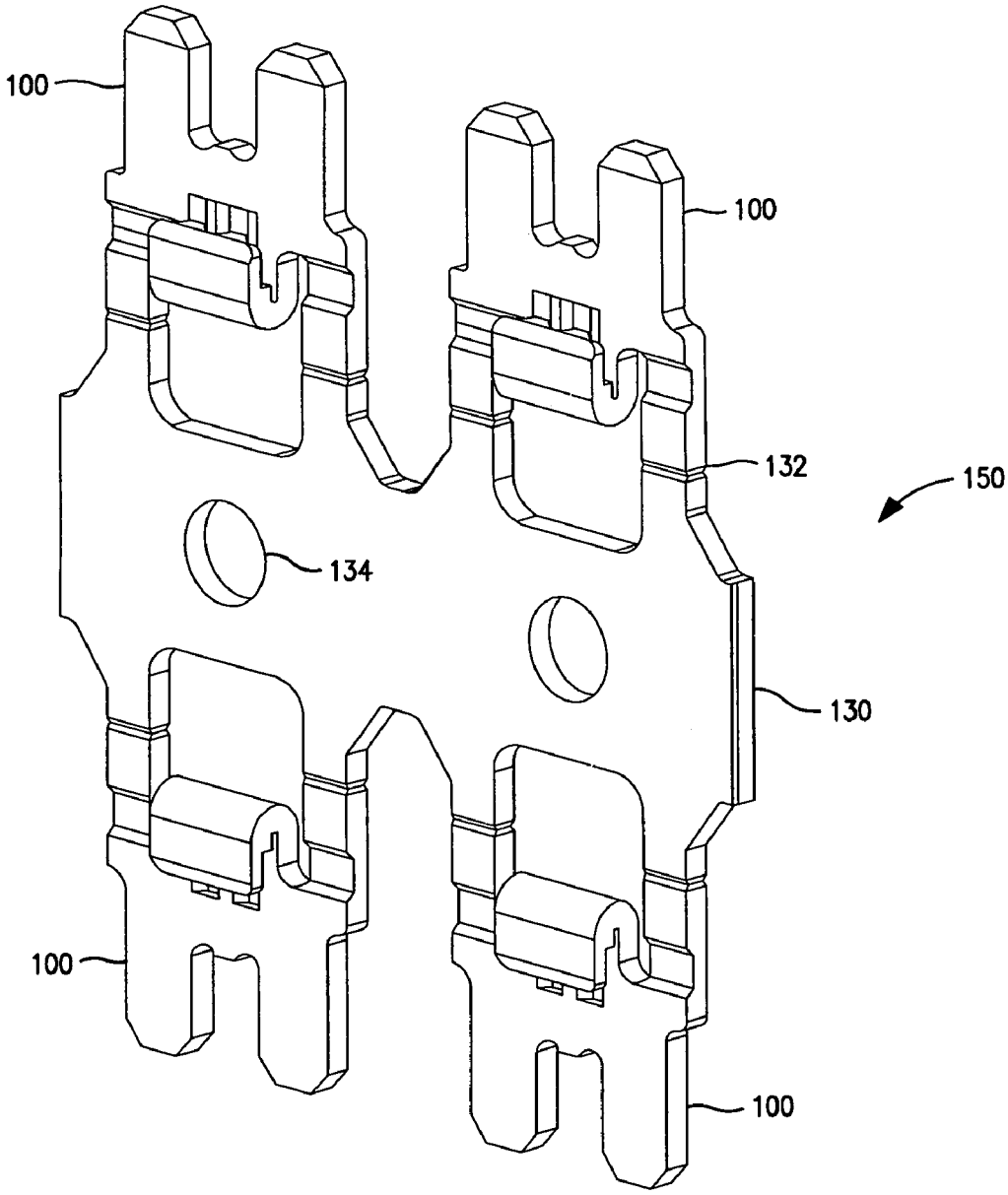
FIG. 1*e* is a perspective view showing a plurality of the end crimp elements joined to a carrier.

In one variant shown in FIG. 1*e*, the crimp elements 100 can be mounted on a carrier 130 to facilitate automated processing and/or allow for improved handling during subsequent manufacturing/processing steps. Such a configuration is particularly advantageous when used in progressive stamping equipment. While the assembly 150 of FIG. 1*e* is shown with four (4) end devices 100 attached to the carrier 130, any number of devices 100 could be added or extended to the assembly 150 in various configurations so that any number (e.g. 6, 8, 10 . . . ) of devices 100 could be utilized on a single carrier 130. Furthermore, while the assembly 150 of FIG. 1*e* shows a substantially symmetrical and mirror-image configuration comprising pairs of end elements 100, such symmetry is not required to practice the invention. For example, the assembly 150 might comprise a single row of commonly oriented elements 100 (i.e., the assembly of FIG. 1*e* effectively cut in half), or a single row of alternating (front/back) elements. Myriad such variations, and alterations are contemplated by the present invention.

In another useful embodiment, the carrier 130 may comprise a continuous reel, so that the devices 100 and carrier 130 can be spooled onto a reel for continuous processing. A continuous reel configuration lends itself to efficient manufacturing techniques such as e.g. progressive crimping of the filament wire 120 to the end crimp element 100 such as through the use of the exemplary automated manufacture equipment 400 discussed with respect to FIGS. 4-4*c* subsequently herein.

Referring again to FIG. 1*e*, the carrier 130 comprises a plurality of holes 134 that can be used for inter alia, feeding purposes. These holes 134 will ideally be located at a common spacing (e.g. 4 mm) to facilitate machine feeding, although sizing and placement of the holes 134 may also be configured for other purposes; e.g., so that the carrier may be utilized on standardized processing equipment. While shown as a single hole 134 per end device 100 pair, any alternative feeding scheme can be utilized consistent with the principles of the present invention. In addition, optional singulation score lines 132 or other comparable mechanisms can be utilized to facilitate the separation of the devices 100 from the carrier 130.

Figure 1F:
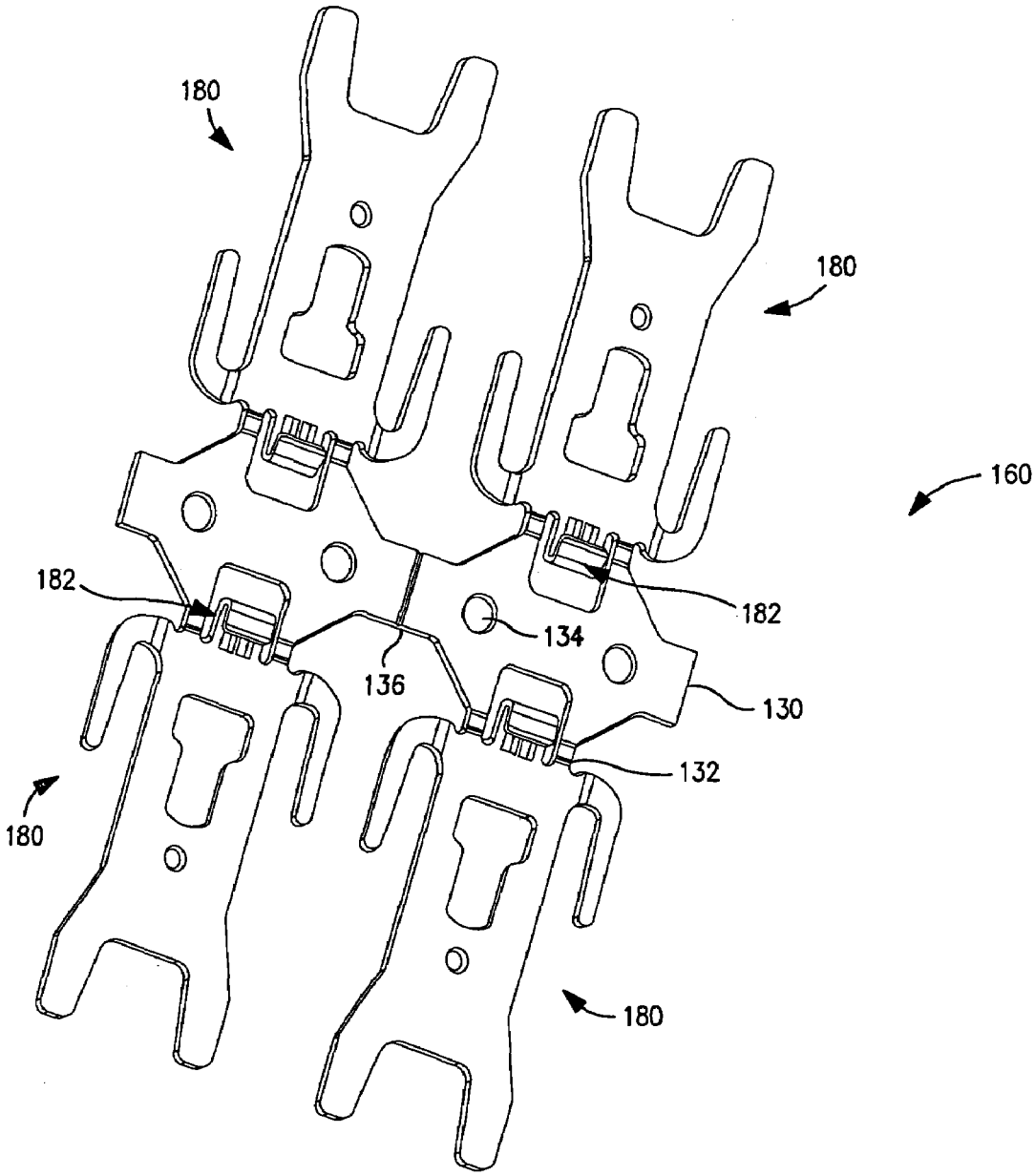
FIG. 1*f* is a perspective view showing a plurality of a central crimp elements joined to a carrier.
Figure 1G:
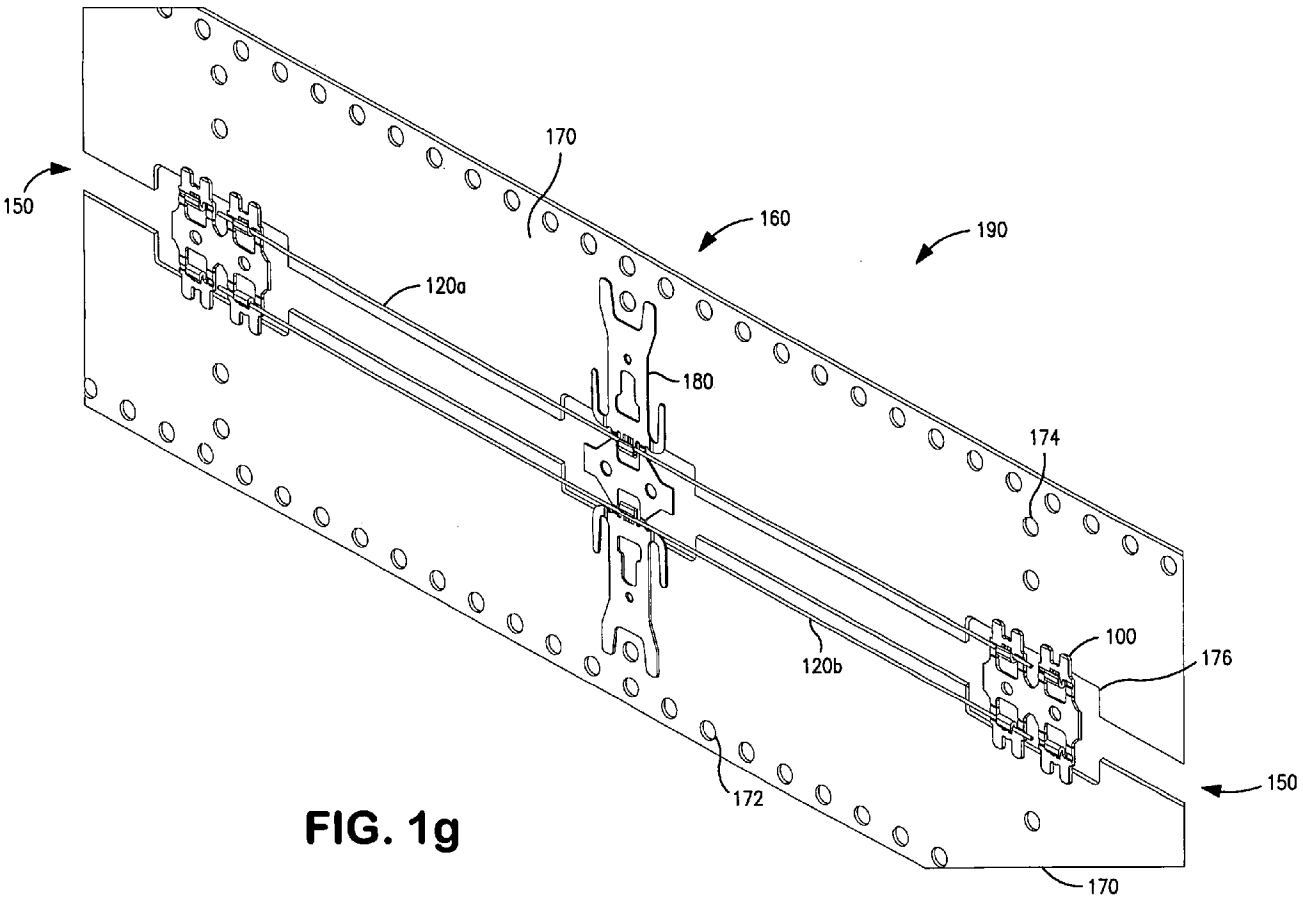
FIG. 1*g* is a perspective view showing the assembly embodiment of FIGS. 1*e* and 1*f* mounted on a polymer carrier adapted for automatic manufacturing processes.

FIG. 1*f* shows a crimp assembly 160 having a plurality (2) of central crimp elements 180. These central crimp elements 180 comprise a complement to the end crimp elements 100 shown in FIGS. 1-1*d*, as discussed subsequently herein with respect to FIG. 1*g*. Although different geometrically, the principles of construction and operation of the central crimp elements 180 (especially the head region 182) are consistent with the end devices 100 previously described.

The term "central" as used with respect to the crimp elements 180 is also merely used for reference in the illustrated embodiment; these crimp elements 180 accordingly may be used in embodiments where they are not central (e.g., they may comprise "ends"), and also may be stationary or movable with respect to the other elements of the assembly. They may also comprise a geometry and/or crimp type that is different in configuration than that shown and that of the end elements 100. The "central" elements 180 may also comprise part of a larger, fixed assembly or device, and may be attached thereto or integral therewith. They also need not necessarily be used with or contain their own crimp.

Note that the carrier 130 shown in the embodiment of FIG. 1*f* comprises two (2) holes 134 per device 180 pair. The device 180 shown in FIG. 1*f* is also larger in scale than the device 100 shown in FIG. 1*e*. These central crimp devices 180 can, in one application, be used in the same assembly 190 as the end elements 100 (shown in FIG. 1*g*) and hence the feed or indexing spacing (i.e., the spacing between adjacent holes 134) has been advantageously chosen to be the same for both the embodiment of FIG. 1*f* and the embodiment of FIG. 1*e*, thereby maintaining a consistent spacing across both assemblies 160, 150.

Referring now to FIG. 1*g*, an exemplary embodiment of a carrier assembly 190 utilizing the assemblies 150, 160 of FIG. 1*e* and FIG. 1*f*, respectively, is shown. The assembly 190 of FIG. 1*g* comprises two polymer carriers 170 fabricated from a material such as e.g. polyvinyl chloride or "PVC", although other materials including for example polyethylene can be used. The two assemblies 150, 160 and two filament wires 120*a*, 120*b* are disposed on the carrier strips 170 utilizing an adhesive on the carrier strip, or tape covering the assemblies (not shown), or both. Ideally such adhesive or tape does not leave any residue on the filament or crimp elements (that might interfere with contact resistance or other properties); one embodiment of the invention accomplishes this result by using a low-transfer white tape (such as, for example, #4236—General Purpose Tensilized Polypropylene TearStrip tape manufactured by Tesa Tape Inc. of Charlotte, N.C., although other tapes with other properties may be substituted). The exemplary tape has no fibers in the paper used to form the tape, although use of such tape is not a requirement for practicing the invention. While only shown in part in FIG. 1*g*, the carrier assembly 190 is intended to be placed on a continuous reel comprising a plurality of the aforementioned assemblies of FIGS. 1*e* and 1*f*, e.g., industry-standard automated processing reels, or any other equivalent device. Custom or proprietary carrier reels can be utilized as well, if desired.

The aforementioned tape can also comprise notches or apertures formed therein and placed coincident with the substantially planar surfaces of the crimp elements 100, 180 so as to allow the pickup and placement of the assemblies while still attached to the carrier.

The carriers 170, as previously mentioned, ideally comprise a sufficiently flexible and low-cost (yet mechanically robust) polymer material such as polyvinyl chloride ("PVC") having a plurality of reel feed holes 172 and assembly holes 174. The reel holes 172 are used for, inter alia, feeding the reel through an automated machine, and may be placed at industry standard, e.g. EIA, spacing if desired so that the resultant reel and end crimping element carrier may be utilized on existing placement equipment. In addition, the carriers 170 also comprises a plurality of clearance slots 176. These slots allow removal of part from carrier (i.e., provide sufficient clearance). It will be appreciated that based on the particular needs of a given application, any of the feed or assembly holes previously described 134, 172, 174 can conceivably be used for indexing and/or establishing proper assembly length, such uses being readily implemented by those of ordinary skill provided the present disclosure.

In the illustrated embodiment, each carrier strip 170 has associated with it: (i) two end crimp elements 100 of the type shown in FIG. 1*e*, (ii) one center crimp element 180 as shown in FIG. 1*f*, and (iii) a filament wire 120 that joins the aforementioned crimp elements 100, 180 together into a single assembly. The filament wire 120 of the illustrated embodiment comprises a shape memory alloy ("SMA"), such as Nitinol wire. Herein lies a salient advantage of this embodiment of the present invention; i.e., the ability to securely crimp Nitinol wire without reducing its strength, yet at a very low cost. This capability stems largely from the particular configuration of the crimp heads 110, 182 of the crimp elements 100, 180.

Variations in the geometry, materials etc. of the assembly 190 of FIG. 1*g*, and combinations thereof, will be readily apparent to one of ordinary skill given the present disclosure.

It will also be recognized that while the illustrated embodiments of the crimp elements 100, 180 of the invention utilize a shape having "arms", "legs", and/or a "body", other embodiments of these elements (not shown) do not include such components, but rather merely a crimp head 110 and cavities 112 and ribs 112*b*. Stated differently, the crimp elements 100, 180 may comprise only the components absolutely necessary to form the crimp of one or more filaments. This configuration may be used, inter alia, for crimping the ends of two filaments together.

Moreover, it will be appreciated by those of ordinary skill that the exemplary configurations of the crimp elements (and carrier strip approach of FIG. 1*g*) advantageously minimize the use of stamped material needed to form the carrier assembly 190 of FIG. 1*g*. Specifically, by using a hole spacing (described previously herein with respect to FIG. 1*e*) that precisely places the individual crimp elements with respect to the processing machinery, no metallic carriers or lead frames (such as those formed within the stamped material used to form the crimp elements themselves) are needed, thereby significantly reducing cost.

In another embodiment of the crimp element, the cavities and ribs 112*a*, 112*b* are replaced with ribs or features that are merely raised above a substantially planar surface or face of the crimping element (as opposed to having cavities form at least one set of the features as in the embodiment of FIG. 1*a*). Accordingly, the crimp element under such a configuration might comprise a flat piece of metal or alloy that simply has two (or two sets) of raised opposed features or ribs that substantially interlock with one another; see for example the embodiment of FIG. 2*b* described subsequently herein.

Figure 1H:
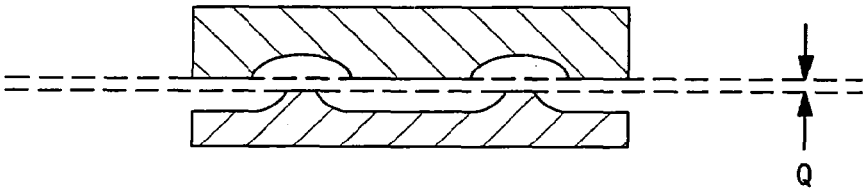
FIG. 1*h* is a sectional view of another embodiment of the crimp element of the invention, wherein an offset (Q) is maintained between opposing crimp features.

In still another embodiment (FIG. 1*h*), the crimp element cavity and rib dimensions relative to the filament dimensions can be altered to cause deflection of the filament into a serpentine or modulated shape without the crimping ribs and cavities 112*a*, 112*b* interacting with one another. Specifically, the plane formed by the top surfaces or edges of one set of ribs or features does not intersect the plan formed by the top surfaces or edges of the opposing set of ribs or features, thereby maintaining an offset (Q) yet still causing significant deflection of the filament to resist extraction thereof from the crimp.

Referring now to FIG. 2, yet another embodiment of a crimp element according to the invention is disclosed. As shown in FIG. 2, this alternate crimp element 200 generally comprises a metal alloy having a plurality of pre-formed arms 202, a plurality of stationary arms 204, an interconnecting base 206, and a leg region 208. The space or gap formed between juxtaposed ones of the pre-formed 202 and stationary (unformed) arms 204 (see FIG. 2*a*) is adapted for the placement of a thin filament 120 such as the aforementioned exemplary Nitinol SMA wire. Features such as e.g. exemplary chamfers 210 shown on the arms 202, 204 and leg 208 reduce the number of sharp edges on the device 200, minimizing the risk of cuts or other deleterious effects when handling these devices. The embodiment of FIG. 2 can have advantages in that the wire need not be "placed" per se, but allows the wire rather to be placed generally between the arms 202, 204 once as shown, and then requires no subsequent movement out of its axial position.

FIG. 2*a* shows a top view of the crimp element 200 of FIG. 2, after crimping has been conducted. Of particular interest is the unique feature of the device 200 that allow the wire 120 to be crimped without damaging the wire 120 itself. Note gap dimension "g" between the pre-formed 202 and stationary arms 204. This gap "g" prevents the filament 120 from being over-compressed or otherwise damaged during crimping, while allowing the filament to remain securely crimped to the device 200.

The embodiment of FIGS. 2-2*a* can be used with either of the end or central crimp elements 100, 180 previously described herein (e.g., as a replacement for the heads 110, 182, or in tandem therewith), or with still other configurations.

Figure 2B:
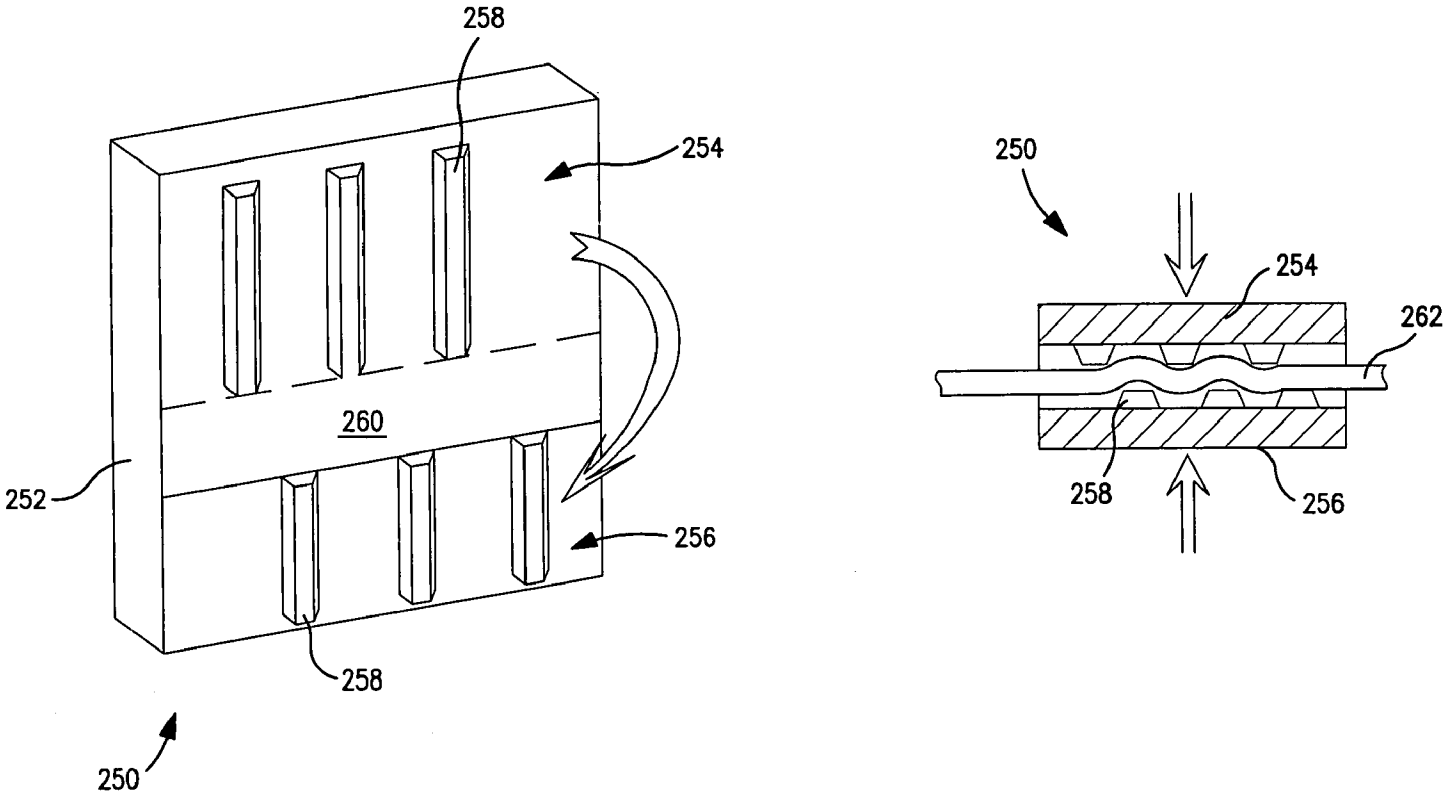
FIG. 2*b* is a combination perspective and sectional view of another embodiment of the crimp element of the invention, shown prior to and after crimping, respectively.

FIG. 2*b* illustrates yet another embodiment of the crimp element of the invention. In this embodiment, the crimp element 250 comprises a substantially planar element 252 with first and second crimp regions 254, 256, each having a set of raised crimp features 258. These crimp features are offset from one another and are designed to substantially interlock, yet with enough distal and lateral spacing so that the filament 262 is deformed into the desired serpentine or modulated shape when crimped.

This embodiment is substantially the inverse of the prior embodiment of FIG. 1; i.e., rather than forming the crimp ribs or features by forming cavities in the crimp element material, the features 258 are formed or raised above the plane of the material.

The features 258 are also ideally configured with somewhat rounded distal (engagement) edges as shown in FIG. 2*b*, thereby mitigating damage to the filament during crimping by way of sharp or highly angular corners.

As with other embodiments, a comparatively softer material is optionally used to form the crimp element 250, so as to further mitigate or eliminate damage to the filament which might weaken it (and the crimp assembly as a whole).

The bending or folding region 260 of the crimp element 250 is kept free from crimp features 258 as shown, so as to facilitate uniform bending of the material in that region without weakening of the material, which could reduce its "clamping" force when crimped (i.e., the force needed to separate the two crimp regions 254, 256 when crimped over the filament).

Manufacturing Methods

Referring now to FIG. 3*a*, an exemplary embodiment of the method 300 for manufacturing the assembly of FIG. 1*g* according to the invention is described.

It will be appreciated that while the following discussion is cast in terms of the exemplary embodiments shown and described with respect to FIGS. 1-2*a* herein, the methods of the present invention are in no way limited to such particular apparatus.

In step 302 of the method 300, a rolled or otherwise continuous sheet of a metal alloy is punched using a progressive stamping equipment to form the end crimp element assembly 150 of FIG. 1*e*. The progressive stamping equipment utilized is adapted to stamp the parts on a continuous sheet. The continuous sheet is then rolled onto another reel for later use. Either in serial or in parallel, progressive stamping equipment is also used to form the central crimp element assembly 160 of FIG. 1*f*.

In step 304, the head elements 110, 182 of the crimp elements of both assemblies 150, 160 are preformed to form an approximate 180 degree bend as best shown in FIG. 1. The preformed bend allows the filament 120 to be easily inserted and held in the crimping head element 110 prior to crimping, when utilized in the automated manufacture equipment 400 of FIGS. 4-4*c*. Note also that step 304 could alternatively be made part of the progressive stamping die utilized in step 302, and thus the head 110, 182 of the crimp elements 100, 180 would therefore be preformed prior to being wound onto a reel.

In step 306, the filament wire 120 (e.g. SMA Nitinol) is routed into the pre-formed crimping head elements 110, 182 using a filament routing apparatus and the filament wire 120 is crimped while the crimping element assemblies 150, 160 are separated from the reel. To accomplish this, a first continuous stamping (e.g. end crimp element assembly 150) is fed into the manufacturing apparatus 400 utilizing a stepper motor. A locating pin engages the stamping at the indexing hole 134 and holds the stamping in place. Filament wire is routed using filament guides into the head element 110. If the filament wire is an SMA such as Nitinol, tension is required in order to ensure proper function of the assembly in the end-user application (such as e.g. SMA linear actuators). For embodiments containing SMA wire, an apparatus is used to maintain a constant and consistent (i.e., uniform, and consistent across multiple assemblies) wire tension of 15-30 g as the wire is placed and routed in the end crimping element heads 110, although other tension values can be used. Wire tension is also optionally monitored in step 306 either continuously or at intermittent time intervals.

In step 308, the preformed crimping head 110 is crimped to secure the filament 120 to the end crimping elements as best shown in FIGS. 1*c*-1*d*. With the filament wire in place, the crimp tool applies holding pressure to the end crimp element assembly 150. A pre-specified number of end crimp elements (e.g. four (4)) are sheared from the continuous strip end crimp element assembly. After shearing, the crimp tool continues to a hard stop to complete the crimping of the filament wire to the end crimping element head 110. Note that typical SMAs such as Nitinol can typically recover stress induced strain by up to about eight (8) percent; therefore, in applications where filament length is relatively small, it is critical to maintain accurate spacing of the end crimping elements connected by the SMA wire. This is the most significant reason for the requirement to maintain proper tension before and during crimping. After crimping, tension is no longer needed on the filament wire 120.

Figure 5A:
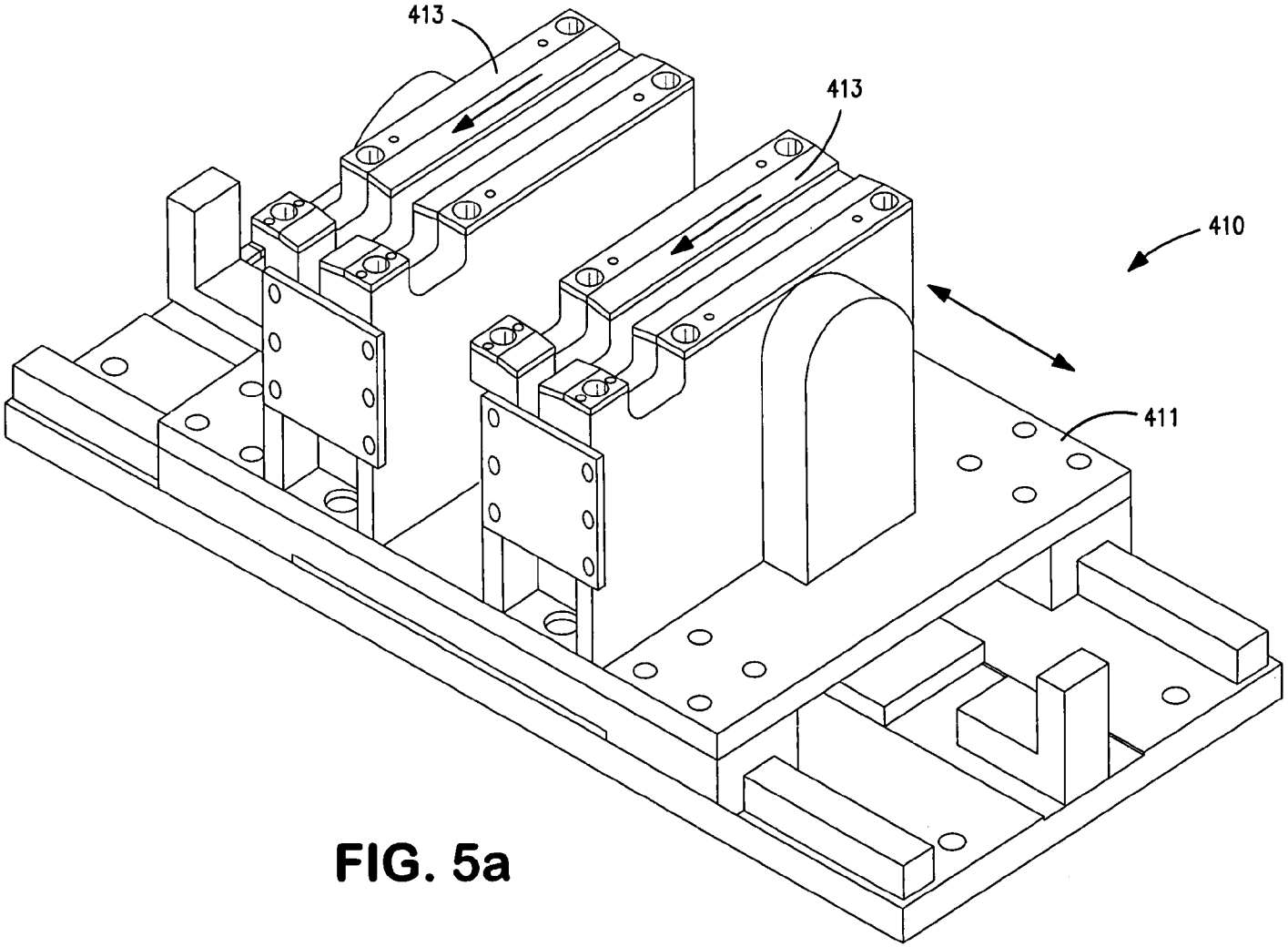
FIG. 5*a* is a perspective view of one exemplary embodiment of the sliding station of the automated manufacture equipment of FIG. 4.
Figure 5B:
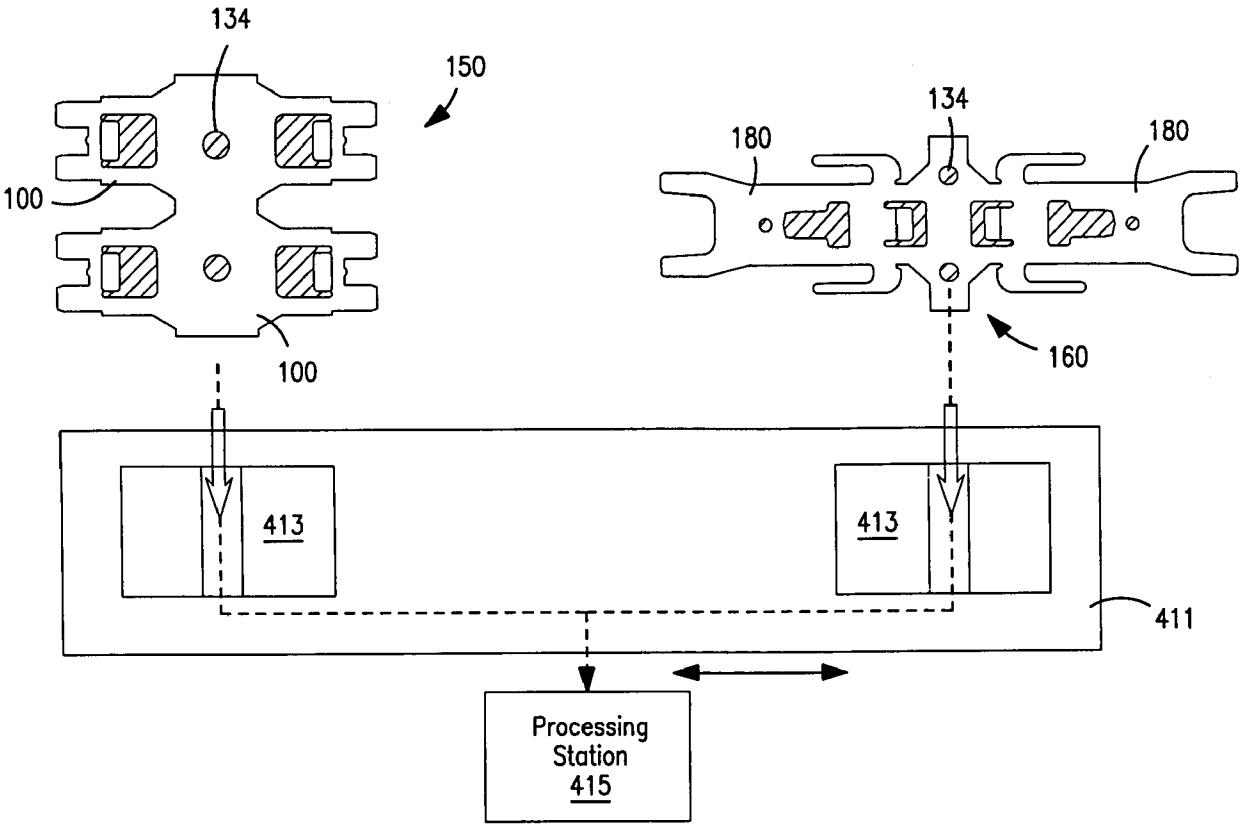
FIG. 5*b* is an elevational view demonstrating the operation of the sliding station of the automated manufacture equipment of FIGS. 4 and 5*a*.
Figure 5C:
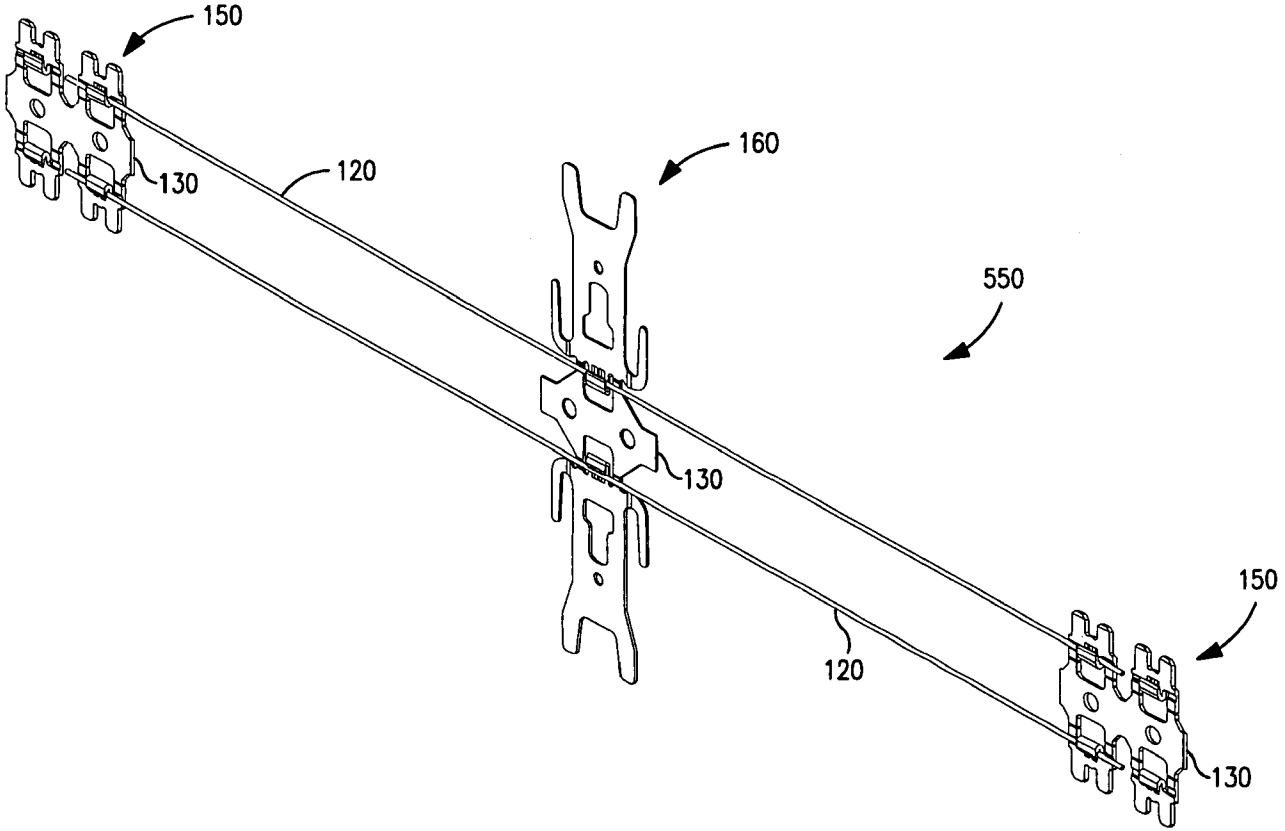
FIG. 5*c* is a perspective view of a final product assembly manufactured using the automated manufacture equipment of FIG. 4.

For mixed assemblies, i.e. those that utilize two or more different crimping elements such as that shown in FIG. 5*c*, and after crimping the end crimping element assembly 150, a locating pin locks the central crimping element assembly 160 into place and advances the central crimping element assembly 160 into the manufacturing apparatus 400 using a stepper motor and the locating pin. The same filament wire utilized for the previously crimped end crimping element assembly 150 is routed into the head 182 of the central crimping element assembly 160. Again, the crimp tool applies holding pressure to the stamping, the central crimping element assembly 160 is separated from the rest of the continuous stamping and the crimp is completed to the central crimping element head 182, locking the filament wire in place. Herein lies yet another advantage of the crimp configuration and method of the present invention; i.e., that the crimp heads 110, 182 can maintain a crimped filament in a constant and unyielding position after the crimp is completed.

Either serially or in parallel to steps 306 and 308, in step 305, PVC sheeting having a thickness of approximately 0.5 mm is punched or otherwise perforated to form the overall dimensions of the PVC carrier strips 170, as well as providing standard indexing holes 172. The indexing holes 172 are preferably punched at the same pitch as the indexing holes 134, used on the end crimping element assembly 150 and center crimping element assembly 160. This is to insure no error in tolerancing when the crimping element assemblies are later assembled onto the carrier 170. The resultant PVC sheeting is then placed onto an industry-standard carrier reel adapted for use on a machine; e.g., one adapted for automated placement of components.

In step 307, the stamping pocket slots 176 and additional part indexing holes 174 are punched or formed into the carrier at a predesignated pitch (e.g., utilizing a user-designated custom pitch). The stamping pocket slots 176 are utilized for clearance during singulation stages after the crimping element assemblies are attached to the carrier. By separating the stamping performed in step 307 from the stamping in step 305, custom dimensions for the indexing holes can be used, advantageously allowing for multiple uses of a single step 305 produced carrier tape. Note that it is envisioned that these steps could alternatively be combined into a single processing step; however, as is disclosed in the current embodiment, it is in many instances desirable to index these features separately so that the indexing pitch may be readily changed without having to re-punch or perforate the entire carrier 170.

Figure 5D:
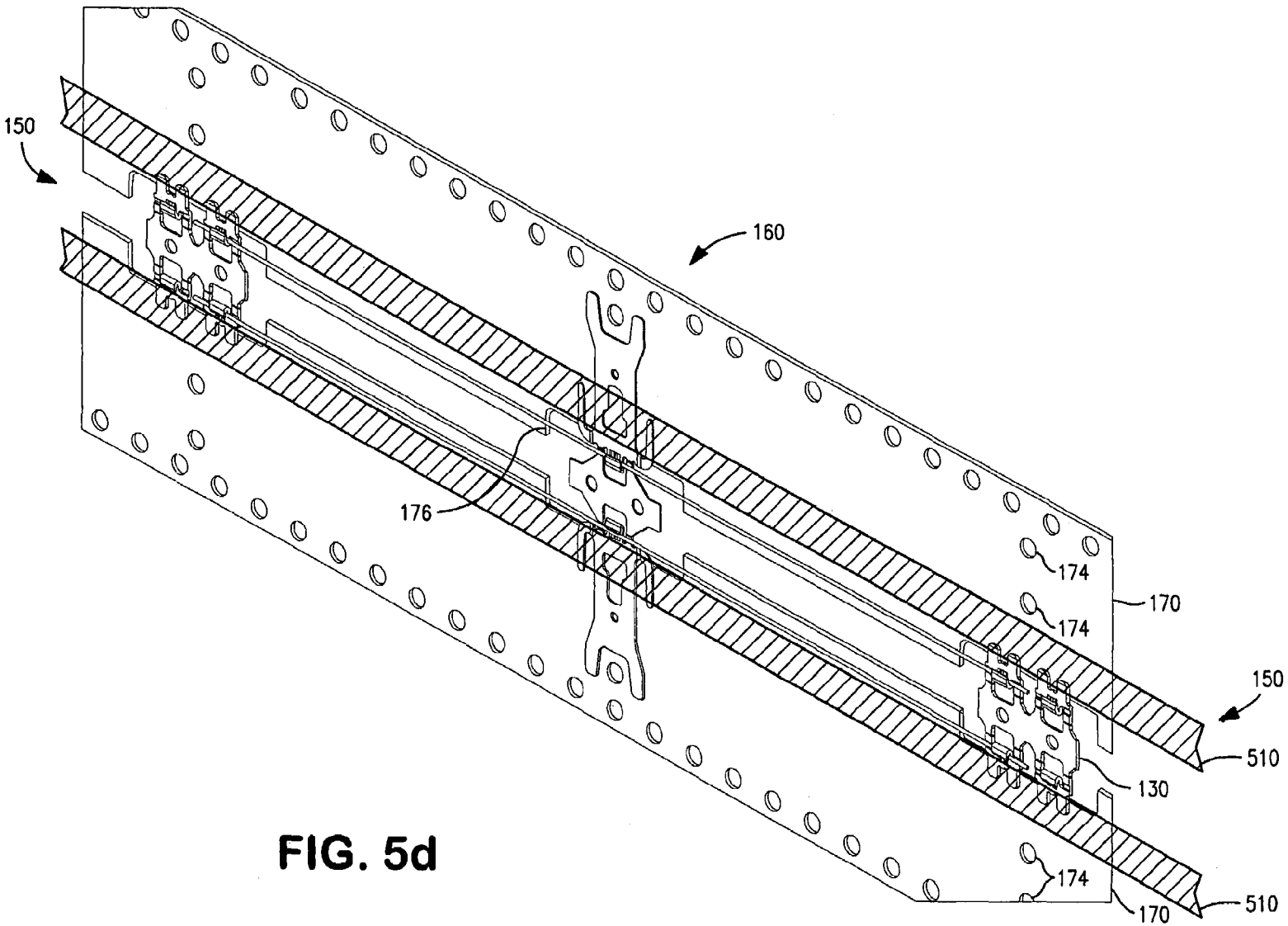
FIG. 5*d* is a perspective view of the final product assembly placed on a carrier tape manufactured using the automated manufacture equipment of FIG. 4.

In step 310 of the method 300, the crimped assemblies are assembled onto the carriers 170 as best shown in FIGS. 1*g* and 5*d*. A tape 510 or adhesive is utilized to secure the assemblies to the carriers 170. For example, the relevant portions of the tape carrier surface may have an adhesive disposed thereon, or a tape can be applied to capture the filament between the tape and the carrier strips 170. The carrier 170 and the crimped assemblies are indexed using a walking beam 450 or similar mechanism which also acts to advance the assembly through the apparatus 400. Other approaches readily known to those of ordinary skill may also be used.

In step 312, the crimped and taped assemblies are loaded into a pneumatic die or the like, and singulated so that the two parallel unitary carriers 170 (see FIG. 1*g*) are separated into two individual carrier tapes with loaded assemblies of the end crimps 100, central crimps, 180, and filament 120. See also FIG. 5*e* which shows these assemblies after singulation.

In step 314, the singulated carrier tape assemblies are loaded; e.g., onto reels for shipment to the end customer, or further processing.

It will be appreciated that any number of combinations of crimping and filament tension may be applied in accordance with various aspects of the present invention. For example, one variant of the methodology described above comprises crimping one end of a filament, and then crimping the other end while placing the filament under tension.

In another variant, the exemplary crimp elements are used in a "loose piece" fashion; e.g., wherein the filament is tensioned, and two or more crimps are applied (e.g., crimped onto what will become the ends of that segment of the filament) under tension.

Automated Manufacture Equipment

Figure 3:
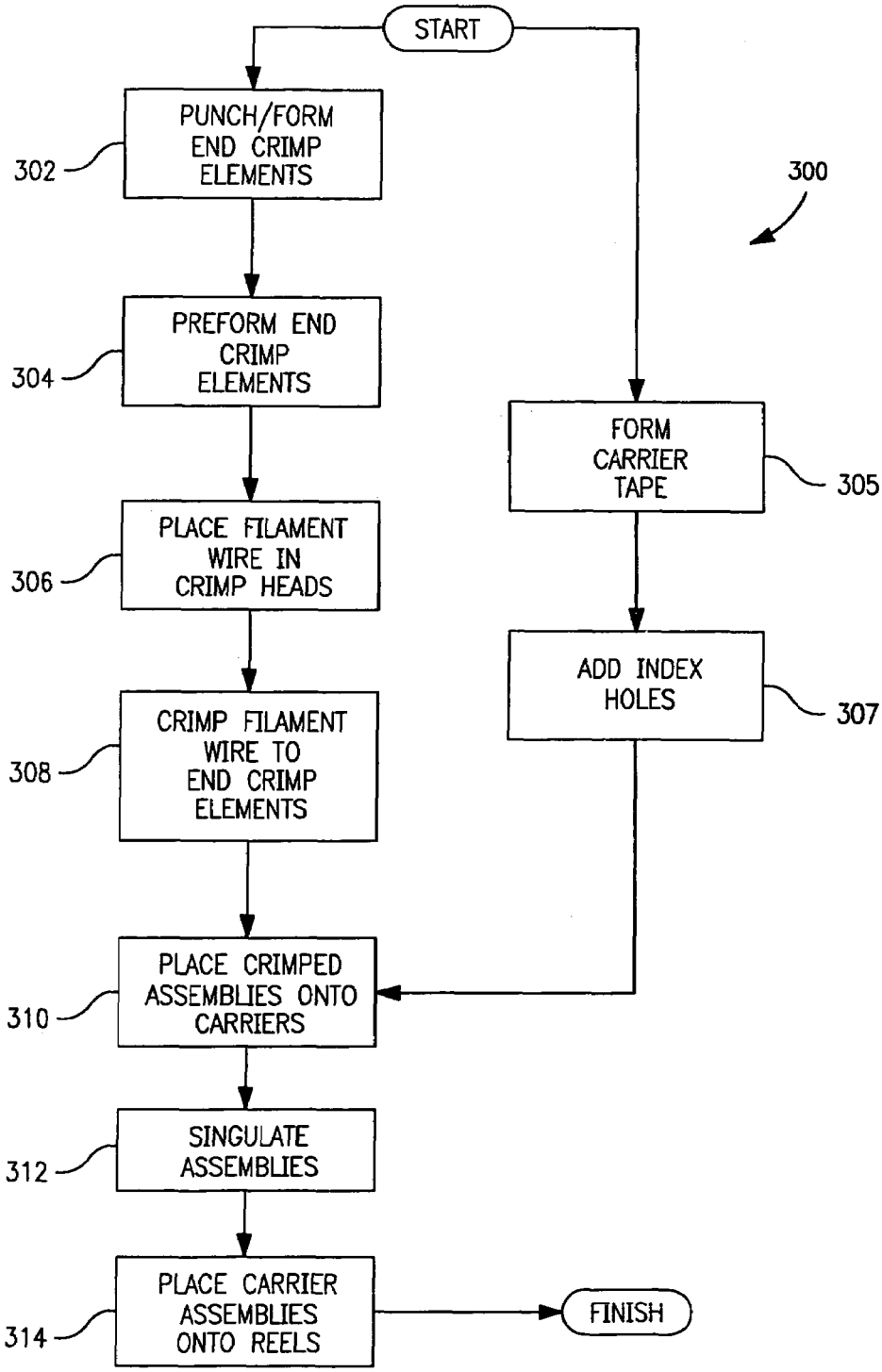
FIG. 3 is a logical flow diagram illustrating one exemplary embodiment of the method of manufacturing the end crimping element carrier assembly of FIG. 1*g*.
Figure 4:
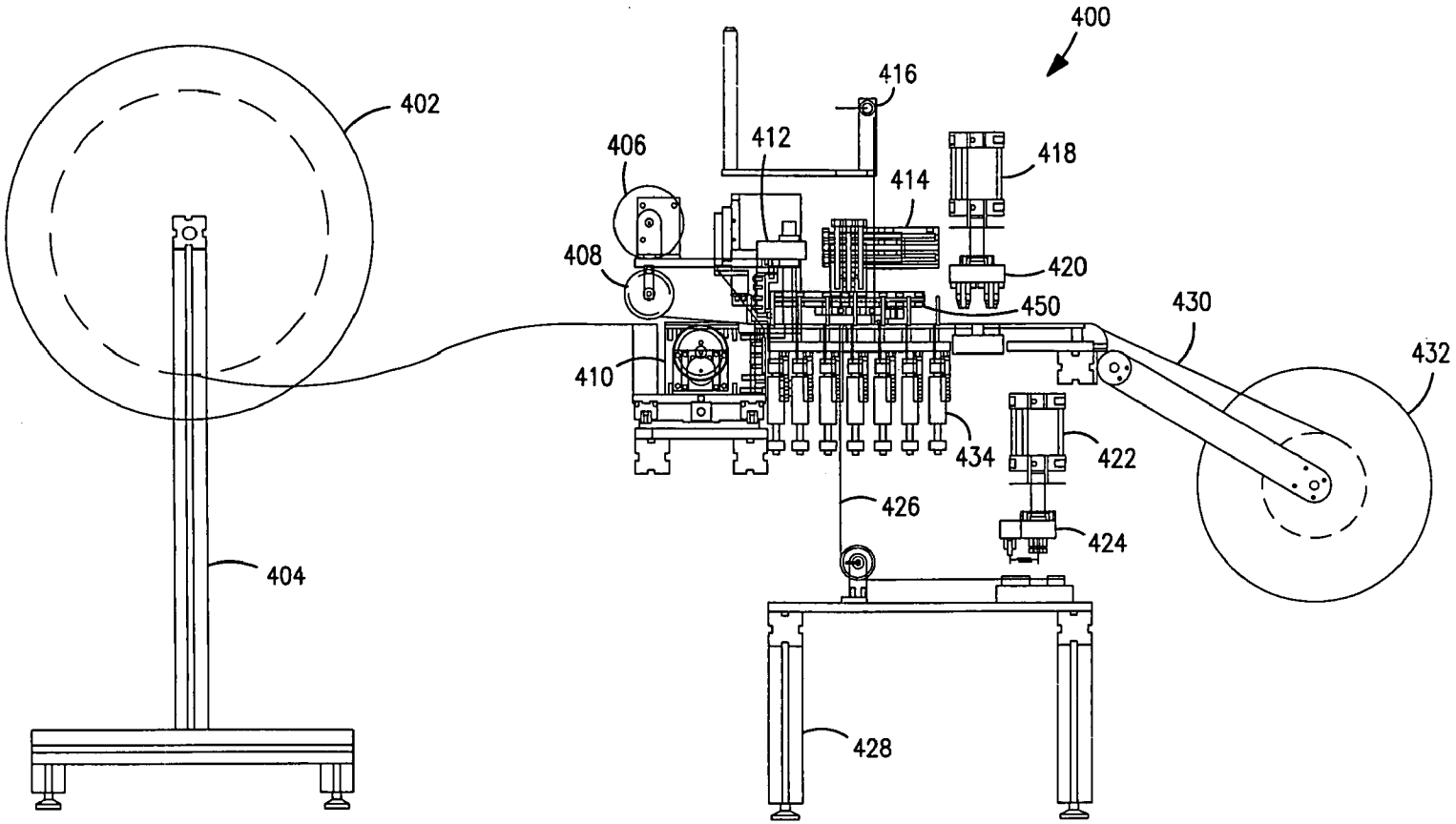
FIG. 4 is a front view of an exemplary embodiment of automated manufacture equipment adapted to manufacture the crimp element carrier assembly of FIG. 1*g*.
Figure 4A:
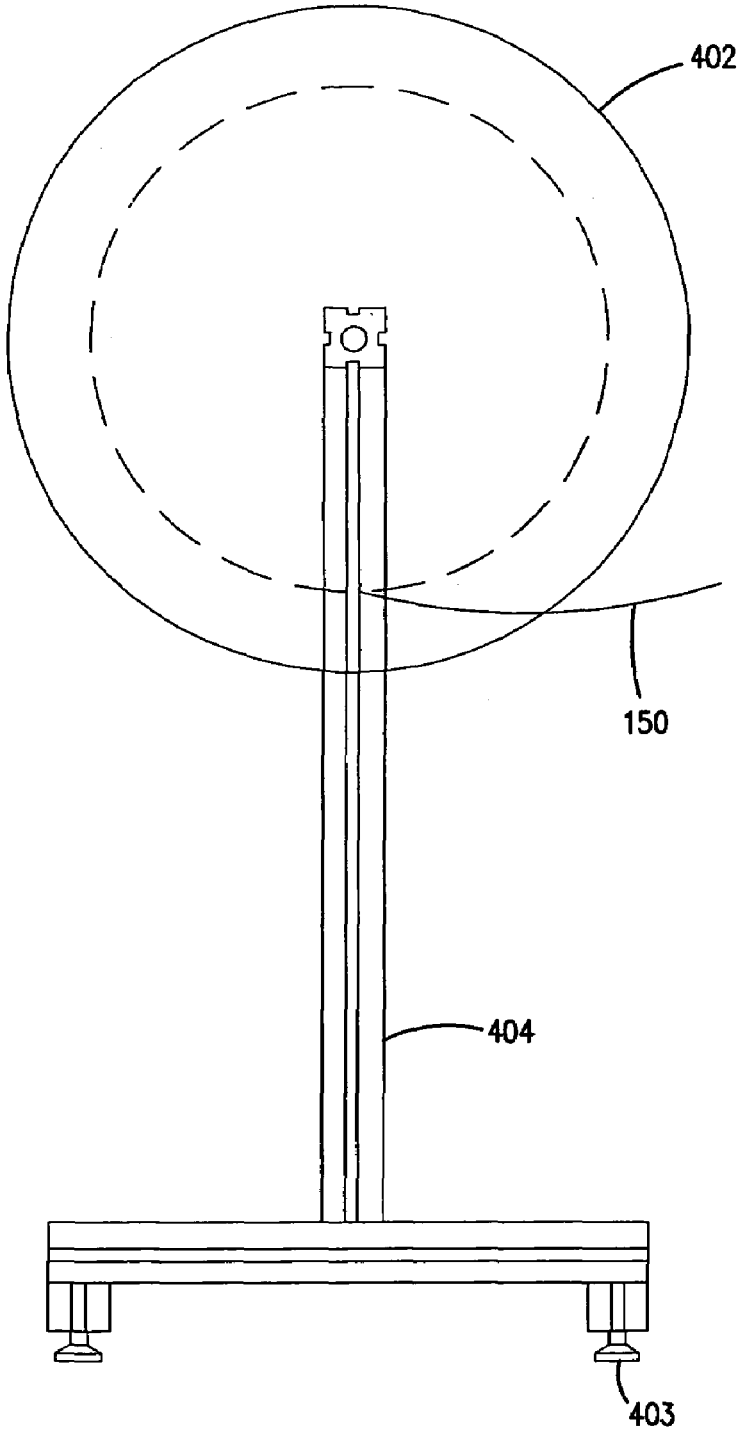
FIG. 4*a* is a front detail view of an exemplary embodiment of the de-reeling station of the automated manufacture equipment of FIG. 4.
Figure 4B:
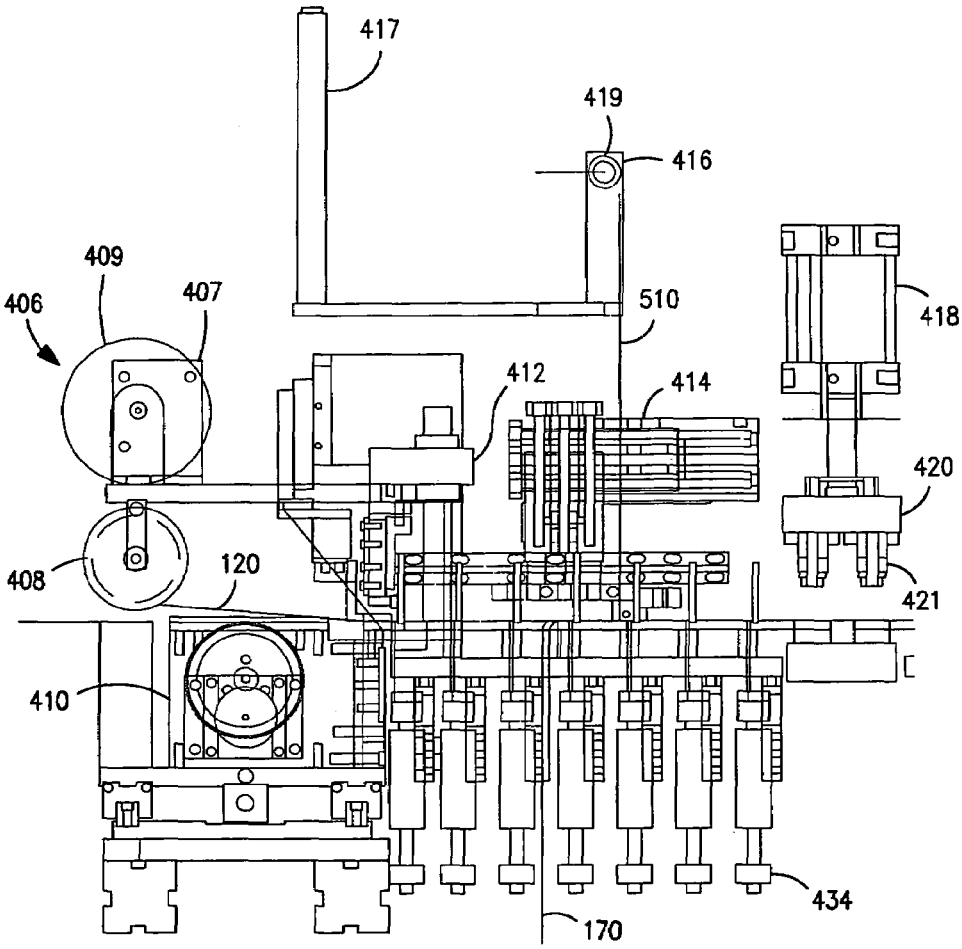
FIG. 4*b* is a front detail view of exemplary embodiments of the crimping and singulating stations of the automated manufacture equipment of FIG. 4.
Figure 4C:
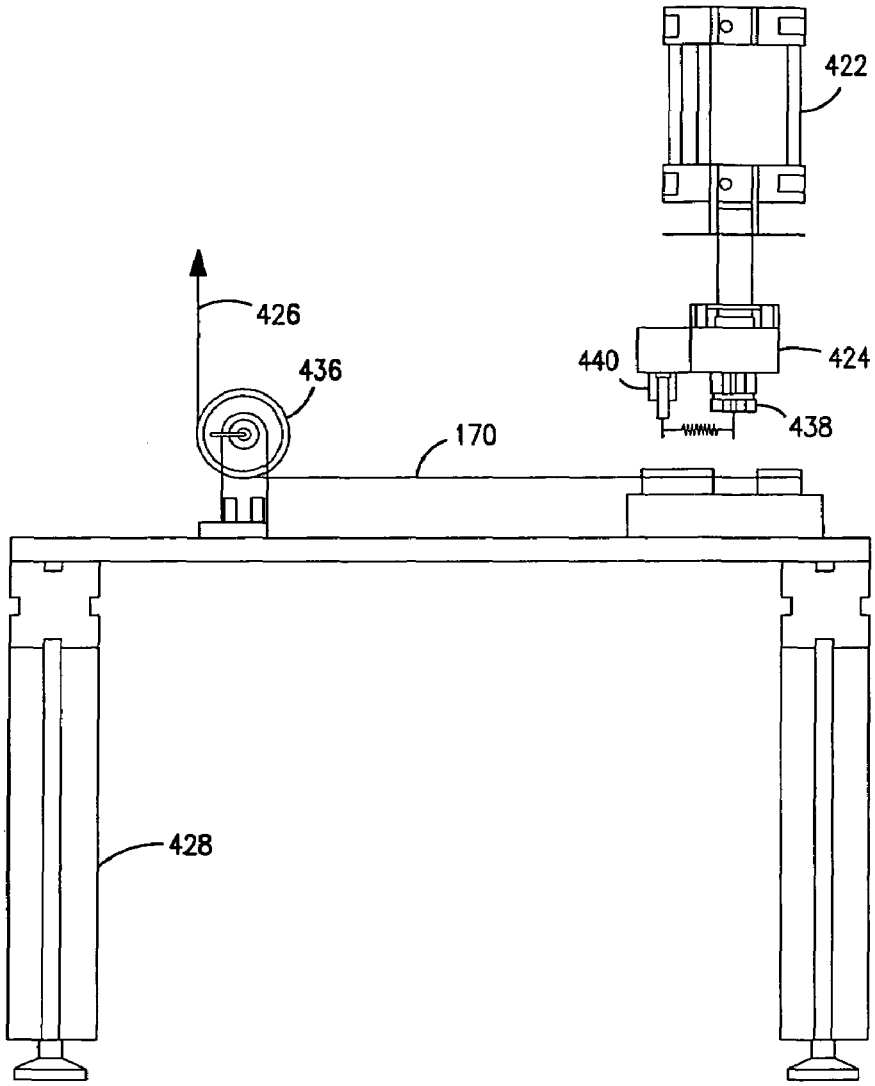
FIG. 4*c* is a front detail view of an exemplary embodiment of the carrier stamping station of the automated manufacture equipment of FIG. 4.
Figure 4D:
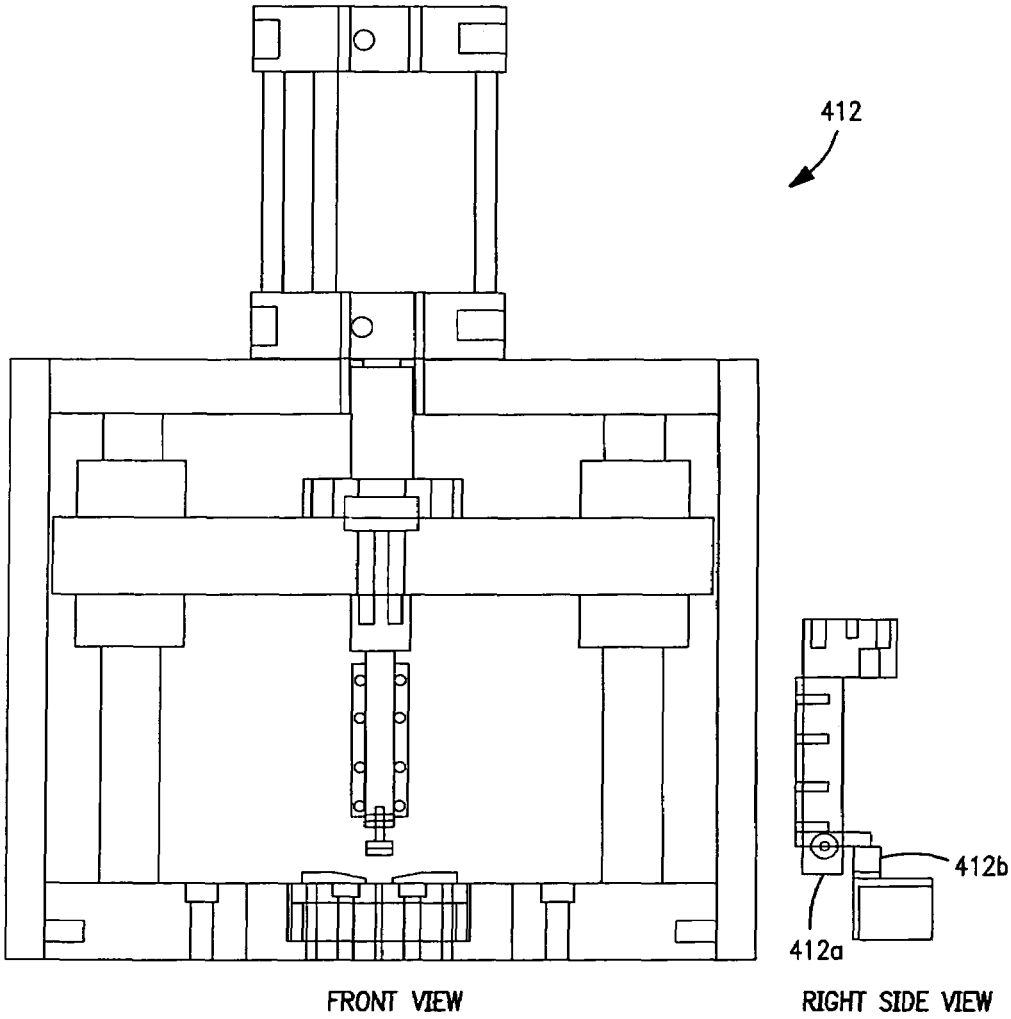
FIG. 4*d* is a front and right side detail view of an exemplary embodiment of the singulation station of the automated manufacture equipment of FIG. 4.
Figure 4E:
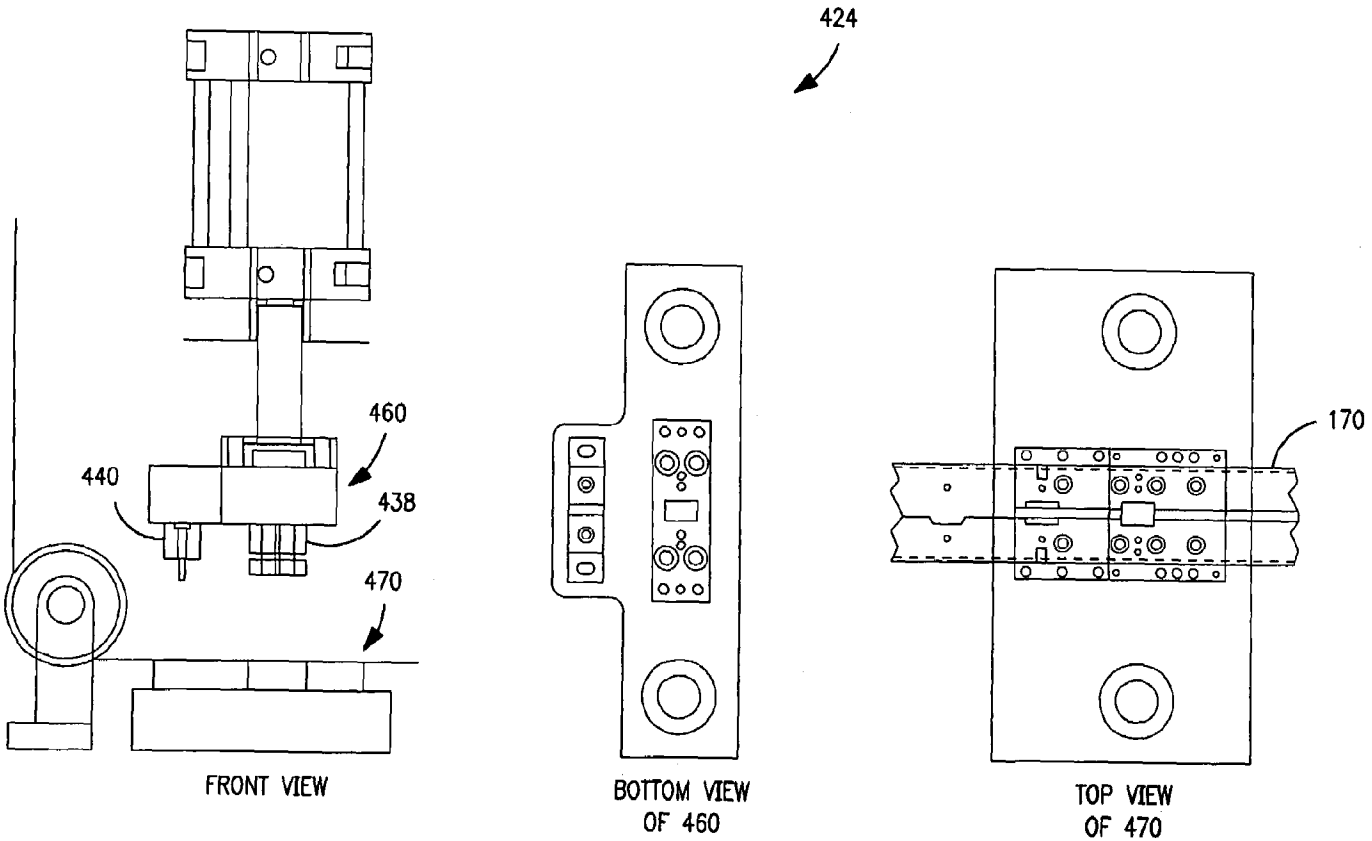
FIG. 4*e* is a front, bottom and top detail view of an exemplary embodiment of the carrier tape punching station that provides indexing holes and slots to the carrier tape.
Figure 4F:
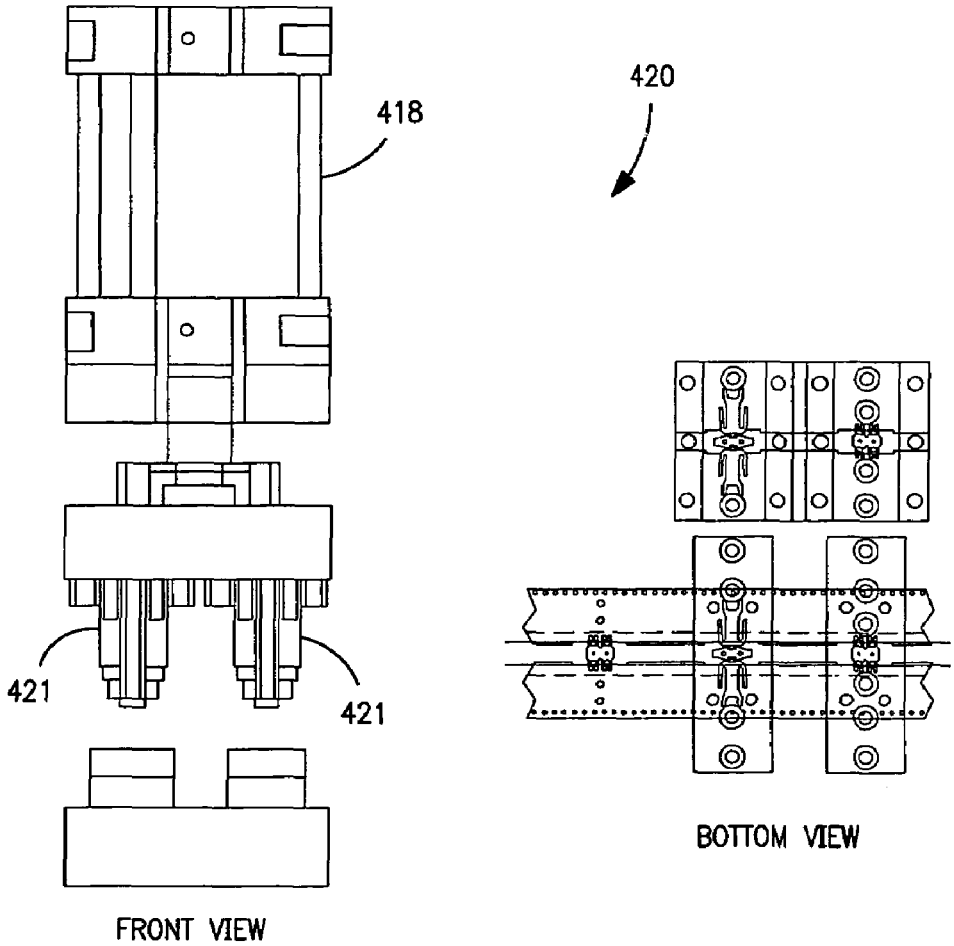
FIG. 4*f* is a front and bottom detail view of an exemplary embodiment of the singulation station which singulates the two carrier tape assemblies into two (2) single (parallel) carrier assemblies.

Referring now to FIGS. 4-4*f*, exemplary embodiments of the manufacturing apparatus 400 adapted to perform the method 300 of FIG. 3 is described in detail.

In the illustrated embodiment, the equipment 400 comprises a plurality of stations, each of which perform a specific task in the manufacture of the end product (e.g., that shown in FIG. 5*e*) and described with regards to FIG. 3. Actuators, including walking beam 450, of the apparatus 400 utilize locating hole features on the stampings to advance the product from station to station. While the equipment 400 will be described primarily in the context of pneumatic actuators driven by a programmable logic controller ("PLC") such as an integrated circuit (IC) microcontroller or digital processor having a computer program running thereon, it is appreciated that myriad other approaches such as e.g. the use of servo or stepper motors for some or all of the movement and actuation functions, separately or in combination with the PLC, could be used consistent with the principles of the present disclosure.

The exemplary apparatus 400 shown in FIG. 4 generally comprises the following stations: (1) a de-reeling station 402 which houses the end crimping element carrier assemblies 150, 160 (also shown in FIG. 4*a*); (2) a filament (e.g., SMA) tensioning station 406 which keeps the SMA wire such as e.g. Nitinol or other filament under proper tension as it is de-spooled (also shown in FIG. 4*b*); (3) a linear slide station 410, which alternates the end crimping element carrier assemblies 150, 160 into the series of stations that follows (also shown in FIG. 5*a*); (4) a singulation station 412*a* which singulates the proper number of end and central crimp element assemblies 150, 160 from the reel station 402 (also shown in FIG. 4*d*); (5) a crimping station 412*b* which crimps the end and central crimp elements to the wire under tension (also shown in FIG. 4*d*); (6) a carrier tape punching station 424 that provides indexing holes and slots to the carrier tape (also shown in FIGS. 4*c* and 4*e*); (7) a taping section 416 that tapes the crimped parts to the carrier tape; (8) another singulation station 420 which singulates the two carrier tape assemblies into two (2) single (parallel) carrier assemblies (also shown in FIG. 4*f*); and (9) a reeling station 432 which reels the final separated parts onto a spool for shipment to an end customer. The following stations will now be described in detail.

Referring now to FIG. 4*a*, the present embodiment of the apparatus 400 comprises two reels 402 (only one being shown for sake of clarity) which are utilized to house the stamped crimp element assemblies 150, 160 of FIGS. 1*e* and 1*f*. These reels 402 contain end product from a continuous progressive stamping or other comparable process, and are easily transported and stored. The reels 402 are supported by a modular and mobile stand 404, which positions the reels at a convenient height, and allows the reels 402 to freely rotate as they are unwound. In the present embodiment, each reel 402 de-spools in a counter-clockwise rotation with the crimp assemblies 150, 160 exiting from the bottom of the reel.

The spool itself comprises a polymer hub with cardboard flanges, although this is but one of many possible configurations. These materials are chosen because they are readily available and cost effective.

The modular stand 404 comprises an aluminum or aluminum alloy, although other materials could be chosen if desired. Aluminum is desirable because, inter alia, it is easily machineable, is lightweight, cost effective, and readily available. Leveling feet 403 are also utilized to make sure the station 402 is level and square during operation of the equipment 400. A payout system using a motor and associated controller, and motion arm (or sensor beam) is used in the exemplary embodiment to ensure that the material is dispensed at an appropriate rate.

In an alternate embodiment, the reel station 402 can be obviated by or replaced with the progressive stamping equipment of the type well known in the art that manufactures the crimp element carrier assemblies previously discussed. The manufactured crimp elements can then be utilized in the automated manufacture equipment 400 immediately following their completion, however such an embodiment tends to be more complicated and provides less operational flexibility than the embodiment of FIG. 4.

Referring now to FIG. 4*b*, various of the stations utilized in the automated manufacture apparatus 400 are described in greater detail.

The tensioning station 406 comprises one or more tensioned spools 409 followed by one or more routing spools 408. A tensioner 407 maintains a uniform tension of between 15-30 g of tension on the SMA (e.g. Nitinol) filament 120 being routed into the subsequent stations. The tensioning station 406 optionally comprises a monitoring apparatus (not shown) disposed proximate to the tensioning spool so that proper tension can be monitored on a periodic or even continuous basis. The tensioning station 406 acts to maintain an accurate tensioning of the filament 120 being crimped into the crimping elements 100, 182. This ensures that the final assembly 550 will actuate accurately in order to control the end-user device properly.

The tensioning station spool(s) 409 and routing spool(s) 408 are advantageously designed to prevent the SMA wire from twisting during the process of being unwound. It is understood by the Assignee hereof that twisting the SMA wire prior to crimping may produce adverse affects on the accuracy of the strain recovery during actuation in the end-user device. Therefore, the tensioning station 406 spools and routing spools 408 are ideally positioned inline with the subsequent wire crimping station 414 so as to mitigate any torsion or other such effects. Further, the tensioning station spools 409 can also optionally be configured to slide laterally as the SMA wire un-spools, thereby helping to ensure that the SMA wire does not become significantly twisted during the routing and crimping processing steps to be discussed subsequently herein. The routing spool 408 advantageously contains a diameter approximately equal to or larger than that of the spool 409 of the tensioning station 406. This feature further ensures that undue stress is not added to the SMA wire 120 by introducing too small of a diameter routing spool. Other features to mitigate stress (such as curved or polished spool surfaces, guides, etc.) can also be utilized to provide optimal transit of the filament between locations within the apparatus 400.

Referring now to the linear slide station 410 of FIGS. 4 and 4*b*, one exemplary embodiment of the slide station 410 acts to both (i) advance the crimp element carrier assemblies 150, 160, as well as (ii) alternate the two separate assemblies into the crimping and taping portions of the equipment 400. As is best illustrated in FIGS. 5*a* and 5*b*, the linear slide station 410 of one embodiment comprises a sliding linear block 411 with guides 413 and corresponding rotating gears (not shown) with a plurality of driver teeth. Each of the crimp element carrier assemblies 150, 160 have their own respective rotating gear and guide 413. The gear teeth are driven by a stepper motor of the type well known in the electrical arts, and adapted to mechanically couple with the indexing holes 134, and advance the carrier assemblies 150, 160 as desired toward the subsequent apparatus station 415. The sliding linear block slides laterally (transverse) to the direction of crimp element propagation, thereby indexing the crimp elements 150, 160 using the same mechanism. In one embodiment (FIG. 5*a*), this is accomplished with two motors with gears, on the block slides, that feed the crimp element(s) to the same die area using lateral movement, followed by motion of the gears to move the assembly forward In the current embodiment, the slide station 410 will first advance the end crimp element carrier assembly 150 to the singulating station 412. A total of four (4) end crimping elements 100 will be singulated from the reel as shown in FIG. 5*b*. Next the linear slide block 411 will position the central crimp element carrier assembly 160 to the singulating station 412. There, a total of two (2) central crimp elements 100 will be singulated, and the aforementioned process will be repeated. The main purpose of the slide station 410 is to be able to efficiently interlace the end and central crimp elements originating from different reels 402 onto the same crimping and taping line. This provides significant efficiencies in terms of space consumed by the apparatus as well as indexing accuracy. Other benefits of this arrangement include ease of changing reels, reloading parts, and adjusting for cutoff.

While discussed primarily in terms of two different supply reels (one for each of the different crimp elements 150, 160), it is envisioned that more than two reels can be utilized.

Further, if only one reel is utilized, the entire sliding station may be obviated for a simpler assembly that merely drives the end crimping element carrier assembly into the resultant processing stations.

In yet another alternate embodiment, the rotary gear 504 may be obviated in place of a linear actuating device (not shown) or other comparable mechanism present on the slide station 410.

Referring now to FIG. 4*d*, the singulating 412*a* and crimping 412*b* stations are described in detail. In the illustrated embodiment, the singulating station 412*a* comprises a hardened tool steel die set operated by a pneumatic cylinder, although other approaches (e.g., electromotive force such as via solenoids or motors) may be used in place thereof, or in combination therewith. The press is operated by a pneumatic cylinder controlled by the aforementioned PLC device. The press acts to singulate the end crimp element carrier assemblies 150 and central crimp element assemblies 160 from their respective reels as the reels are advanced through the die while in the same motion crimping the filament wire into either the end or central crimping element assemblies.

The hardened steel die set comprises an anvil, a stripper plate (which firmly holds the assembly in place during the cutting operation), filament wire routing apparatus and a cutting/crimping die. As the die opens, actuators retract and allow the end crimping element carrier assembly 150, 160 to advance within the die using the walking beam 450. Prior to being stamped, the walking beam 450 disengages and other actuators engage the end and/or center crimping element carrier assembly and hold the piece in place as it is singulated. Singulating dies are well understood in the mechanical arts and as such will not be discussed further herein.

In the illustrated embodiment, the crimping station 412*b* of the apparatus 400 operates to crimp each of the end and central crimp elements 100, 180 to the Nitinol filament wire 120 that has been routed via the routing apparatus. The crimping station 412*b* of this embodiment is similar to the aforementioned singulating station 412*a* in that it comprises a hardened die steel set operated by the same pneumatic press as before, however other approaches (e.g., electromotive force such as via solenoids or motors) may be used in place thereof, or in combination therewith. Alternatively, the crimping and singulating dies could be separated into two separate die structures if desired. These and various other alternatives may readily be implemented by one of ordinary skill given the present disclosure.

In the illustrated embodiment, the press is operated by a pneumatic cylinder controlled by the aforementioned PLC device. The resultant assembly 550 produced by this process (after three (3) singulating/crimping cyles) is best shown in FIG. 5*c*, with the assembly 550 comprising two Nitinol filament wires 120 attached on either end to an end crimp element carrier assembly 150. Because the singulation and crimping occurs in the same die set, control of the apparatus 400 is simplified. In between the two end crimp element assemblies 150, a central crimp element carrier assembly 160 is also crimped to the Nitinol wire 120.

Referring now to FIGS. 4*c* and 4*e*, the exemplary embodiment of the carrier tape punching station 424 is described in detail. The carrier tape 170 is fed from a reel (not shown) and advanced to the carrier tape punching station 424. The carrier tape strips 170 themselves may advantageously comprise Electronic Industries Alliance (EIA) compliant components, so that the final product assembly 550 may be placed using industry standard automated processes, although custom or proprietary designs are also contemplated. The carrier tape punching station comprises a die set having a part indexing punch 440 to produce an indexing punch hole 174 (see FIG. 1*g*). The die set also comprises a slot punching die 438 to punch the pocket slot 176 shown in FIG. 1*g*. The slot punching die 438 creates the pocket slot 176 in the carrier 170 and is utilized to ensure adequate clearance during processing steps (i.e. singulation) to the end and center crimping element assemblies that are performed after these assemblies have been mounted to the carrier (i.e. at station 420). The entire press is operated using a pneumatic press cylinder 422 controlled by a controller, such as the aforementioned PLC controller, although non-pneumatic variants are also contemplated as previously described.

A rotary actuator utilizes the punched sprocket holes 172 to advance the carrier tape strips 170 through the station 424 and onto subsequent manufacturing stations. Note that it is preferable that the pitch between sprocket holes 172 be identical to the pitch used on the crimping element assemblies 150, 160. By maintaining an identical pitch, the crimping element assemblies and carrier tape can be advanced together (such as by using the aforementioned walking beam 450) ensuring proper alignment between the various components during subsequent processing steps. Referring back to station 424, the punched carrier tape 170 is then routed to a position past the aforementioned crimping station 414 via a pulley 436 using a de-reeler motor (not shown). The carrier is routed so that the crimp/filament assembly 550 (FIG. 5*c*) may be placed onto the carrier 170. The entire station 424 (excluding the reel) is mounted on a mounting stand 428 comprising an aluminum structure, although other types of support structures can be readily substituted.

Referring again to FIG. 4*b*, the exemplary embodiment of the carrier taping station 416 is described in detail. The taping station comprises a spool 417 and a pulley 419 adapted to route a cover tape 510 down to the crimped assemblies and the carrier tape strips 170. The spool 417 comprises a plurality of cover tape 510 windings (not shown). A placement mechanism routes the tape, with the adhesive side down, onto the crimp/filament assemblies 550, which have been routed over the carrier tape 170 and aligned therewith using the aforementioned walking beam 450. The assemblies 550 are then secured to the carrier 170 by the tape 510, as is best shown in FIG. 5*d*. This process utilizes a mechanism which places light pressure to secure the tape to the assemblies 550 and the tape 170. The use of cover tapes 510 for securing electronic components to carrier tapes 170 are well understood in the electronic packaging arts and as such will not be discussed further herein. It will be appreciated, however, that other approaches may be used in place of the aforementioned taping process, such as coating the relevant side of the carrier tape with an adhesive (which could also be activated and/or cured upon exposure to heat, UV light, electrical current, etc.), thereby allowing the crimp/filament assemblies 150 to be placed atop the carrier tape strips 170 and bonded directly thereto. Spot-application of adhesives or other bonding agents could also be utilized.

Figure 5E:
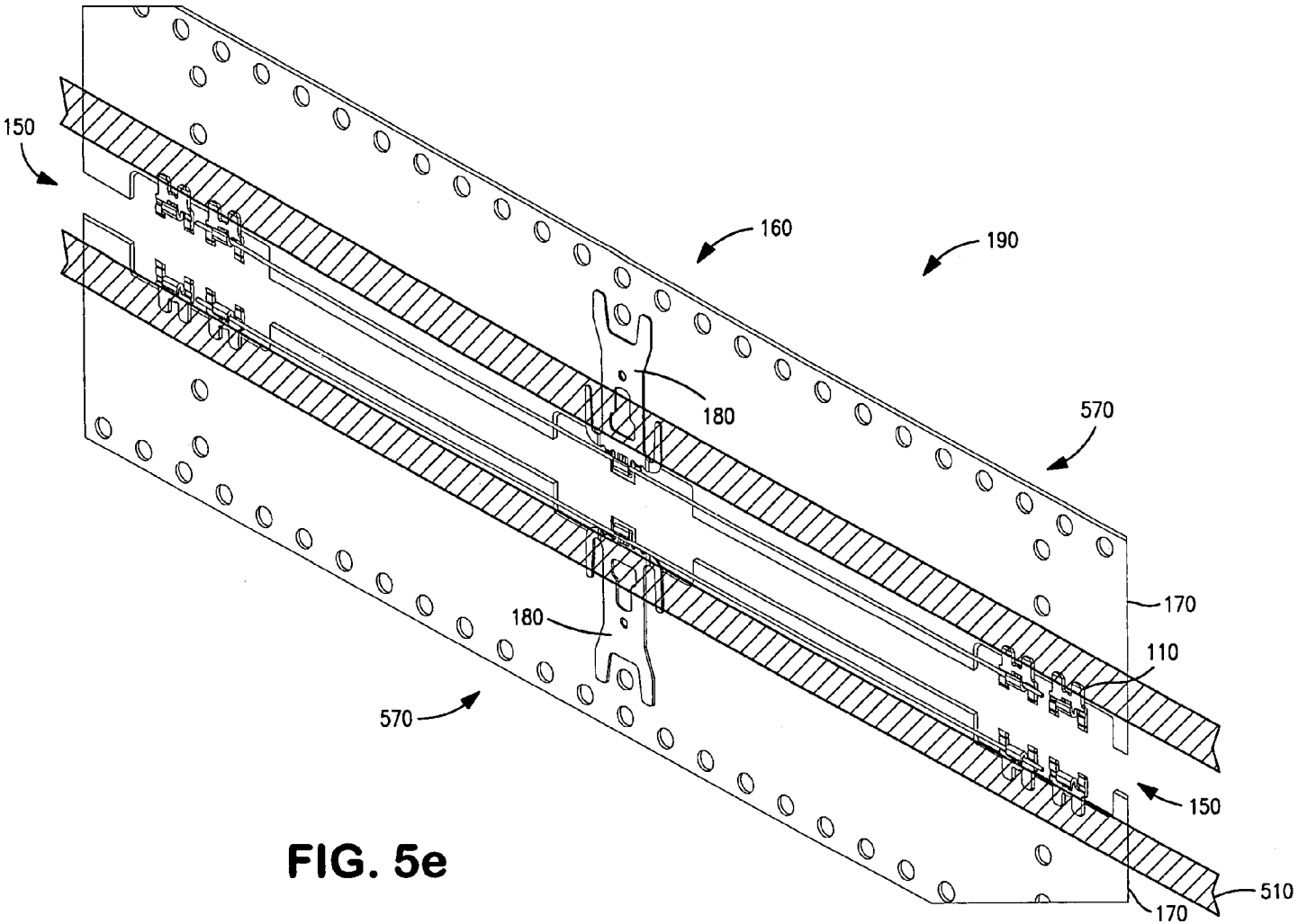
FIG. 5*e* is a perspective view of the final product assembly shown in FIG. 5*d*, after the assembly has been singulated using the automated manufacture equipment of FIG. 4.

Referring now to FIG. 4*f*, the singulation station 420 is shown which comprises a singulation die adapted to remove the end and central crimp element carriers 130 after the assemblies 550 have been secured to their respective carrier tapes 170. The singulation station 420 comprises one or more hardened steel dies 421 operated by a pneumatic press 418, similar to the first singulation station 412. The die and anvil set of the present singulation die 421 removes the end and central crimp carriers (salvage strips) 130, rather then singulating the crimp element carrier assemblies 150, 160 from the reeling station 402. The singulation station 420 will also advantageously separate the filament wire at a predesignated location to further separate the carrier assemblies so that they each comprise two (2) end crimping elements 100; a filament wire 120; and a center crimping element 180. As best shown in FIG. 5*e*, the resultant assembly 190 with the end crimping element carrier 130 assemblies' removed effectively results in two separate carrier tape assemblies 570.

While primarily contemplated as processing two separate carrier tape assemblies 570 in parallel, in order to reduce material waste during the initial progressive stamping of the crimp element carrier assemblies 150, 160, more or less tape assemblies could be processed at the same time, as would be readily apparent to one of ordinary skill given the present disclosure. For example, the apparatus 400 can be readily adapted to process four (4) carrier tape strips 170 and two sets of parallel end crimps 100 and central crimps 180, so as to produce four final assemblies 570.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. A filament crimping element, said element comprising:

a first plurality of cavities, said first plurality of cavities disposed at a spacing which creates a first plurality of features; and a second plurality of cavities, said second plurality of cavities disposed at a spacing which creates a second plurality of features;

wherein said first and second pluralities of cavities are substantially opposite to yet substantially offset from one another when said crimping element is crimped;

wherein said first and second pluralities of cavities and features form a substantially serpentine channel therebetween for receiving said filament when said crimping element is crimped; and wherein when said crimping element is crimped around said filament, no part of said first plurality of features is received within said second plurality of cavities, and no part of said second plurality of features is received within said first plurality of cavities.

2. The crimping element of claim 1, wherein said first and second features each comprise substantially rounded edges, said substantially rounded edges mitigating deformation of at least a portion of said filament during crimping.

3. The crimping element of claim 1, wherein said first and second features each comprise filament engagement surfaces having substantially rounded profiles, said substantially rounded profiles mitigating deformation of at least a portion of said filament during crimping.

4. The crimping element of claim 1, further comprising a filament, said filament having a first end placed at least partially within said substantially serpentine channel of said filament crimping element.

5. The crimping element of claim 4, wherein said filament comprises a Nickel-Titanium shaped memory alloy.

6. The crimping element of claim 4, comprising a second filament crimping element disposed at a second end of said filament.

7. The crimping element of claim 6, comprising a third filament crimping element disposed substantially between said first and second filament crimping elements.

8. A filament crimping element, said element comprising:

a first plurality of cavities, said first plurality of cavities disposed at a spacing which creates a first plurality of features; and a second plurality of cavities, said second plurality of cavities disposed at a spacing which creates a second plurality of features;

wherein said first and second pluralities of cavities are substantially opposite to yet substantially offset from one another when said crimping element is crimped;

wherein said first and second pluralities of cavities and features form a substantially serpentine channel therebetween for receiving said filament when said crimping element is crimped; and wherein said first features are substantially juxtaposed and coplanar with one another in a first plane, and said second features are substantially juxtaposed and coplanar with one another in a second plane, and when said crimping element is crimped around said filament, said first and second planes do not intersect.

9. The crimping element of claim 8, wherein at least one of each of said first and second pluralities of features comprises substantially rounded edges, said substantially rounded edges mitigating deformation of at least a portion of said filament during crimping.

10. The crimping element of claim 9, further comprising a filament, said filament being placed at least partially within said substantially serpentine channel of said filament crimping element so that said filament substantially assumes a serpentine shape.

11. The crimping element of claim 10, wherein said crimping element is formed from a material which has a hardness less than that of said filament, said lesser hardness of said material at least mitigating deformation of said filament by said crimping element during crimping.

12. The crimping element of claim 8, wherein said first and second pluralities of cavities are configured to mitigate physical damage to said filament during crimping.

13. The crimping element of claim 8, wherein during said crimping, a prescribed level of tension is applied to said filament.

14. The crimping element of claim 8, wherein said crimping element is adapted to crimp only a single filament at a time.

15. The crimping element of claim 8, said filament is retained within said crimping element by said filament substantially assuming the shape of a channel formed between said first and second pluralities of features.

16. A filament crimping element, said element comprising:

a first plurality of cavities; and a second plurality of cavities;

wherein said first and second pluralities of cavities are substantially opposite to yet substantially offset from one another when said crimping element is crimped, and form a substantially serpentine channel therebetween for receiving said filament, such that said filament assumes a shape defined substantially by said channel when said crimping element is crimped;

wherein said first and second plurality of cavities are disposed at a spacing which creates a first and second plurality of features respectively; and wherein when said crimping element is crimped around said filament, no part of said first plurality of features is received within said second plurality of cavities, and no part of said second plurality of features is received within said first plurality of cavities.

17. The crimping element of claim 16, wherein said first and second features each comprise substantially rounded edges, said substantially rounded edges mitigating deformation of at least a portion of said filament during crimping.

18. The crimping element of claim 16, wherein said first and second features each comprise filament engagement surfaces having substantially rounded profiles, said substantially rounded profiles mitigating deformation of at least a portion of said filament during crimping.

19. The crimping element of claim 16, wherein said element is comprised of a material which is softer than said filament.

20. The crimping element of claim 16, wherein when said crimping element is crimped, the cross-sectional shape of said filament received within is not significantly deformed.

21. The crimping element of claim 16, wherein said filament comprises Nitinol wire.

22. The crimping element of claim 16, further adapted to maintain said filament in a locked position relative said element after said crimping element is crimped.

23. A filament crimping element, said element comprising:

a first plurality of cavities; and a second plurality of cavities;

wherein said first and second pluralities of cavities are substantially opposite to yet substantially offset from one another when said crimping element is crimped, and form a substantially serpentine channel therebetween for receiving said filament, such that said filament assumes a shape defined substantially by said channel when said crimping element is crimped;

wherein said first and second plurality of cavities are disposed at a spacing which creates a first and second plurality of features respectively; and wherein said first features are substantially juxtaposed and coplanar with one another in a first plane, and said second features are substantially juxtaposed and coplanar with one another in a second plane, and when said crimping element is crimped around said filament, said first and second planes do not intersect.

24. The crimping element of claim 23, wherein said filament comprises a Nickel-Titanium shaped memory alloy.

25. The crimping element of claim 23, comprising a second filament crimping element disposed at a second end of said filament.

26. The crimping element of claim 25, comprising a third filament crimping element disposed substantially between said first and second filament crimping elements.

27. The crimping element of claim 23, further comprising at least one arm having a substantially planar surface formed thereof adapted for pickup by a pick-and-place machine.

28. The crimping element of claim 23, wherein at least one of each of said first and second pluralities of features comprises substantially rounded edges, said substantially rounded edges mitigating deformation of at least a portion of said filament during crimping.

29. The crimping element of claim 23, wherein said crimping element is formed from a material which has a hardness less than that of said filament, said lesser hardness of said material at least mitigating deformation of said filament by said crimping element during crimping.

30. The crimping element of claim 23, wherein said first and second pluralities of cavities mitigate physical damage to said filament during crimping.

* * * * *